US009196189B2

(12) United States Patent
Gandhi et al.

(10) Patent No.: US 9,196,189 B2
(45) Date of Patent: Nov. 24, 2015

(54) DISPLAY DEVICES AND METHODS FOR GENERATING IMAGES THEREON

(75) Inventors: Jignesh Gandhi, Burlington, MA (US); Edward Buckley, Winchester, MA (US)

(73) Assignee: Pixtronix, Inc., San Diego, CA (US)

( * ) Notice: Subject to any disclaimer, the term of this patent is extended or adjusted under 35 U.S.C. 154(b) by 248 days.

(21) Appl. No.: 13/468,922

(22) Filed: May 10, 2012

(65) Prior Publication Data

US 2012/0287144 A1 Nov. 15, 2012

Related U.S. Application Data

(60) Provisional application No. 61/485,990, filed on May 13, 2011, provisional application No. 61/551,345, filed on Oct. 25, 2011.

(51) Int. Cl.
*G09G 5/00* (2006.01)
*G09G 5/10* (2006.01)
(Continued)

(52) U.S. Cl.
CPC ..... *G09G 3/2029* (2013.01); *G09G 3/2092* (2013.01); *G09G 3/3413* (2013.01);
(Continued)

(58) Field of Classification Search
USPC ..... 345/581, 589–590, 690, 600–602, 204, 345/214, 20, 22, 45, 48, 63, 77, 84, 88–89; 348/552, 557, 560, 571, 578, 630–631, 348/701, 708, 715, 739, 742, 750, 758, 348/760; 359/237, 242; 358/509, 512, 518, 358/523; 382/162, 167, 254, 274, 305
See application file for complete search history.

(56) References Cited

U.S. PATENT DOCUMENTS 6,518,977 B1 2/2003 Naka et al.
8,022,924 B2 9/2011 Weng et al.
(Continued)

FOREIGN PATENT DOCUMENTS

CN 1698089 A 11/2005
CN 1848220 A 10/2006
(Continued)

OTHER PUBLICATIONS

International Search Report and Written Opinion—PCT/US2012/037606—ISA/EPO—Jul. 30, 2012.
(Continued)

*Primary Examiner* — Wesner Sajous
(74) *Attorney, Agent, or Firm* — Edward A. Gordon; Foley & Lardner LLP

(57) ABSTRACT

A display includes pixels and a controller. The controller can cause the pixels to generate colors corresponding to an image frame. The controller can cause the display to display the image frame using sets of subframe images corresponding to contributing colors according to a field sequential color (FSC) image formation process. The contributing colors include component colors and at least one composite color, which is substantially a combination of at least two component colors. A greater number of subframe images corresponding to a first component color can be displayed relative to a number of subframe images corresponding to another component color. The display can be configured to output a given luminance of a contributing color for a first pixel by generating a first set of pixel states and output the same luminance of the contributing color for a second pixel by generating a second, different set of pixel states.

28 Claims, 29 Drawing Sheets

(51) Int. Cl.

| | |
|---|---|
| ***G09G 1/28*** | (2006.01) |
| ***G09G 3/16*** | (2006.01) |
| ***G09G 3/30*** | (2006.01) |
| ***H04N 5/46*** | (2006.01) |
| ***H04N 9/64*** | (2006.01) |
| ***H04N 9/12*** | (2006.01) |
| ***G03F 3/08*** | (2006.01) |
| ***G06K 9/00*** | (2006.01) |
| ***G06K 9/40*** | (2006.01) |
| ***G09G 5/02*** | (2006.01) |
| ***G09G 3/20*** | (2006.01) |
| *G09G 3/34* | (2006.01) |

(52) U.S. Cl.

CPC ..... *G09G2310/0235* (2013.01); *G09G 2320/0247* (2013.01); *G09G 2320/064* (2013.01); *G09G 2340/0428* (2013.01)

(56) References Cited

U.S. PATENT DOCUMENTS

| | | | | |
|---|---|---|---|---|
| 8,723,900 | B2 | 5/2014 | Akimoto et al. | |
| 2006/0232601 | A1 | 10/2006 | Kimura et al. | |
| 2007/0064008 | A1 | 3/2007 | Childers | |
| 2007/0086078 | A1 | 4/2007 | Hagood et al. | |
| 2007/0146509 | A1* | 6/2007 | Hekstra et al. | 348/253 |
| 2007/0205969 | A1 | 9/2007 | Hagood, IV et al. | |
| 2008/0204382 | A1 | 8/2008 | Lim et al. | |
| 2008/0211973 | A1* | 9/2008 | Hekstra et al. | 348/760 |
| 2009/0091525 | A1 | 4/2009 | Hsu et al. | |
| 2009/0180039 | A1* | 7/2009 | Endo et al. | 348/760 |
| 2009/0185140 | A1* | 7/2009 | Chen et al. | 353/31 |
| 2010/0208148 | A1* | 8/2010 | Deppe | 348/744 |
| 2010/0295865 | A1 | 11/2010 | Wu et al. | |
| 2012/0287139 | A1* | 11/2012 | Wyatt | 345/520 |
| 2012/0320111 | A1* | 12/2012 | Hagood et al. | 345/690 |

FOREIGN PATENT DOCUMENTS

| | | | |
|---|---|---|---|
| EP | 0896317 | A2 | 2/1999 |
| GB | 2336931 | A | 11/1999 |
| JP | 11085110 | A | 3/1999 |
| JP | H11109916 | A | 4/1999 |
| JP | 11160649 | A | 6/1999 |
| JP | H11352941 | A | 12/1999 |
| JP | 2003287733 | A | 10/2003 |
| JP | 2006317909 | A | 11/2006 |
| JP | 2007122018 | A | 5/2007 |
| JP | 2008165126 | A | 7/2008 |
| RU | 2249257 | C2 | 3/2005 |
| TW | 558709 | | 10/2003 |
| TW | I261220 | | 9/2006 |
| TW | 200828235 | | 7/2008 |
| WO | WO2008088892 | | 7/2008 |
| WO | WO2010062647 | | 6/2010 |

OTHER PUBLICATIONS

Taiwan Search Report—TW101117017—TIPO—Oct. 1, 2014.

* cited by examiner

1050

| Bit# | 7 | 6 | 5 | 4 | 3 | 2 | 1 | 0 | Luminance Level |
|---|---|---|---|---|---|---|---|---|---|
| Weight | 128 | 64 | 32 | 16 | 8 | 4 | 2 | 1 | |
| 1 | 0 | 1 | 1 | 1 | 1 | 1 | 1 | 1 | 127 |
| 2 | 1 | 0 | 0 | 0 | 0 | 0 | 0 | 0 | 128 |

Figure 10

1140

| Bit# | 11 | 10 | 9 | 8 | 7 | 6 | 5 | 4 | 3 | 2 | 1 | 0 | Luminance Level |
|---|---|---|---|---|---|---|---|---|---|---|---|---|---|
| Weight | 70 | 52 | 38 | 27 | 19 | 14 | 12 | 10 | 6 | 4 | 2 | 1 | |
| | 1 | 0 | 0 | 1 | 0 | 1 | 0 | 1 | 0 | 1 | 1 | 1 | 128 |
| | 1 | 0 | 0 | 1 | 0 | 0 | 1 | 1 | 1 | 0 | 1 | 1 | 128 |
| | 1 | 0 | 0 | 0 | 1 | 1 | 1 | 0 | 1 | 1 | 1 | 1 | 128 |
| | 0 | 0 | 1 | 1 | 1 | 1 | 1 | 1 | 1 | 0 | 1 | 0 | 128 |
| | 0 | 1 | 0 | 1 | 0 | 1 | 1 | 1 | 1 | 1 | 1 | 1 | 128 |
| | 1 | 0 | 1 | 0 | 1 | 0 | 0 | 0 | 0 | 0 | 0 | 0 | 127 |
| | 1 | 1 | 0 | 0 | 0 | 0 | 0 | 0 | 0 | 1 | 0 | 1 | 127 |
| | 0 | 1 | 1 | 1 | 0 | 0 | 0 | 1 | 0 | 0 | 0 | 0 | 127 |
| | 0 | 1 | 1 | 0 | 1 | 1 | 0 | 0 | 0 | 1 | 0 | 0 | 127 |
| | 0 | 0 | 1 | 1 | 1 | 1 | 1 | 1 | 1 | 0 | 0 | 1 | 127 |

1142

1144

Figure 11

1200

| | | | | | | |
|---|---|---|---|---|---|---|
| .. | .. | .. | .. | .. | .. | .. |
| .. | .. | A1 | A1 | A1 | A1 | .. |
| .. | .. | A2 | A2 | A2 | B1 | .. |
| .. | .. | A1 | A1 | B2 | B2 | .. |
| .. | .. | A2 | B1 | B1 | B2 | .. |
| .. | .. | B2 | B2 | B2 | B1 | .. |
| .. | .. | .. | .. | .. | .. | .. |

Figure 12A

1220

| | Bit# | 11 | 10 | 9 | 8 | 7 | 6 | 5 | 4 | 3 | 2 | 1 | 0 | Luminance Level |
|---|---|---|---|---|---|---|---|---|---|---|---|---|---|---|
| | Weight | 70 | 52 | 38 | 27 | 19 | 14 | 12 | 10 | 6 | 4 | 2 | 1 | |
| A1 | | 0 | 0 | 1 | 1 | 1 | 1 | 1 | 1 | 1 | 0 | 1 | 0 | 128 |
| A2 | | 0 | 1 | 0 | 1 | 0 | 1 | 1 | 1 | 1 | 1 | 1 | 1 | 128 |
| B1 | | 0 | 1 | 1 | 0 | 1 | 1 | 0 | 0 | 0 | 1 | 0 | 0 | 127 |
| B2 | | 0 | 1 | 1 | 0 | 1 | 0 | 1 | 0 | 1 | 0 | 0 | 0 | 127 |

Figure 12B

1230

| | | | | | | |
|---|---|---|---|---|---|---|
| $\mathbf{b}^A$ | $\mathbf{b}^B$ | $\mathbf{b}^A$ | $\mathbf{b}^B$ | ... | $\mathbf{b}^A$ | $\mathbf{b}^B$ |
| $\mathbf{b}^B$ | $\mathbf{b}^A$ | $\mathbf{b}^B$ | $\mathbf{b}^A$ | ... | $\mathbf{b}^B$ | $\mathbf{b}^A$ |
| $\mathbf{b}^A$ | $\mathbf{b}^B$ | $\mathbf{b}^A$ | $\mathbf{b}^B$ | ... | $\mathbf{b}^A$ | $\mathbf{b}^B$ |
| ... | ... | ... | ... | ... | ... | ... |
| $\mathbf{b}^A$ | $\mathbf{b}^B$ | $\mathbf{b}^A$ | $\mathbf{b}^B$ | ... | $\mathbf{b}^A$ | $\mathbf{b}^B$ |
| $\mathbf{b}^B$ | $\mathbf{b}^A$ | $\mathbf{b}^B$ | $\mathbf{b}^A$ | ... | $\mathbf{b}^B$ | $\mathbf{b}^A$ |

Figure 12C

1242

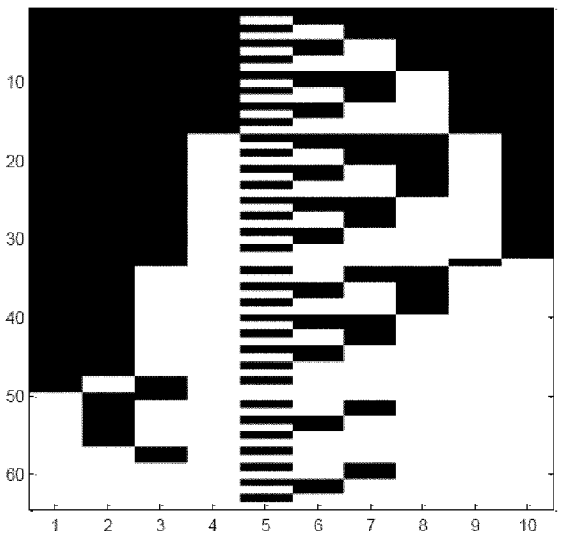

1244

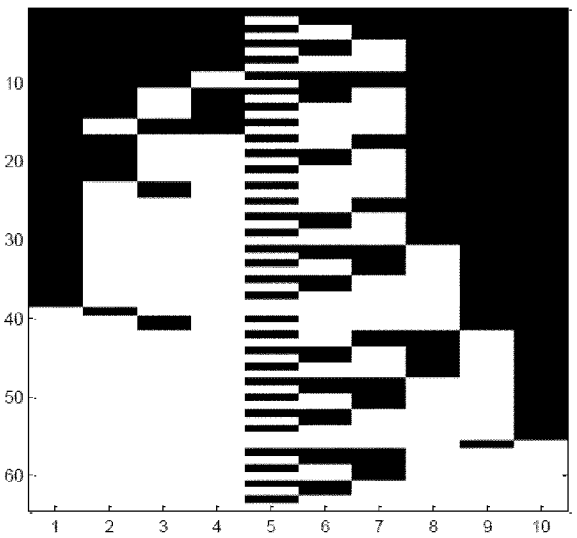

Figure 12D

1250

| | | | | | |
|---|---|---|---|---|---|
| $\mathbf{b}^A$ | $\mathbf{b}^B$ | $\mathbf{b}^A$ | $\mathbf{b}^B$ | ... | $\mathbf{b}^A$ $\mathbf{b}^B$ |
| $\mathbf{b}^C$ | $\mathbf{b}^D$ | $\mathbf{b}^C$ | $\mathbf{b}^D$ | ... | $\mathbf{b}^C$ $\mathbf{b}^D$ |
| ... | ... | ... | ... | ... | ... |
| $\mathbf{b}^A$ | $\mathbf{b}^B$ | $\mathbf{b}^A$ | $\mathbf{b}^B$ | ... | $\mathbf{b}^A$ $\mathbf{b}^B$ |
| $\mathbf{b}^C$ | $\mathbf{b}^D$ | $\mathbf{b}^C$ | $\mathbf{b}^D$ | ... | $\mathbf{b}^C$ $\mathbf{b}^D$ |

Figure 12E

1302

| Color | Bit # | Weight |
|---|---|---|
| R | 0 | 1 |
| R | 4 | 8 |
| R | 2 | 4 |
| R | 4 | 8 |
| R | 7 | 64 |
| R | 6 | 32 |
| R | 5 | 16 |
| R | 3 | 8 |
| R | 7 | 64 |
| R | 6 | 32 |
| R | 5 | 16 |
| R | 1 | 2 |
| G | 0 | 1 |
| G | 4 | 8 |
| G | 7 | 64 |
| G | 2 | 4 |
| G | **3** | **8** |
| G | 7 | 64 |
| G | 6 | 32 |
| G | 5 | 16 |
| G | **4** | **8** |
| G | 6 | 32 |
| G | 5 | 16 |
| G | 1 | 2 |
| B | 0 | 1 |
| B | 4 | 8 |
| B | 7 | 64 |
| B | 6 | 32 |
| B | 5 | 16 |
| B | 1 | 2 |
| B | 2 | 4 |
| B | 4 | 8 |
| B | 7 | 64 |
| B | 6 | 32 |
| B | 5 | 16 |
| B | 3 | 8 |

1304

| Color | Bit # | Weight |
|---|---|---|
| R | 0 | 1 |
| R | 4 | 8 |
| R | 2 | 4 |
| R | 4 | 8 |
| R | 7 | 64 |
| R | 6 | 32 |
| R | 5 | 16 |
| R | 3 | 8 |
| R | 7 | 64 |
| R | 6 | 32 |
| R | 5 | 16 |
| R | 1 | 2 |
| G | 0 | 1 |
| G | 4 | 8 |
| G | 7 | 64 |
| G | 2 | 4 |
| G | **4** | **8** |
| G | 7 | 64 |
| G | 6 | 32 |
| G | 5 | 16 |
| G | **3** | **8** |
| G | 6 | 32 |
| G | 5 | 16 |
| G | 1 | 2 |
| B | 0 | 1 |
| B | 4 | 8 |
| B | 7 | 64 |
| B | 6 | 32 |
| B | 5 | 16 |
| B | 1 | 2 |
| B | 2 | 4 |
| B | 4 | 8 |
| B | 7 | 64 |
| B | 6 | 32 |
| B | 5 | 16 |
| B | 3 | 8 |

Figure 13

1502

| Color | R | R | R | G | G | G | G | B | B | R | R | R | R | R | G | G | G | G | B | B | B | B | B | B |
|---|---|---|---|---|---|---|---|---|---|---|---|---|---|---|---|---|---|---|---|---|---|---|---|---|
| Bit # | 7 | 6 | 5 | 4 | 7 | 6 | 5 | 7 | 6 | 0 | 1 | 2 | 3 | 4 | 0 | 1 | 2 | 3 | 0 | 1 | 2 | 3 | 4 | 5 |

Figure 15A

1504

1505A 1506A 1505B 1506B

| Color | R | R | R | R | R | G | G | G | G | G | G | B | B | B | B | R | R | R | R | R | R | G | G | G | G | G | G | B | B | B | B | B | B | B |
|---|---|---|---|---|---|---|---|---|---|---|---|---|---|---|---|---|---|---|---|---|---|---|---|---|---|---|---|---|---|---|---|---|---|---|
| Bit # | 0 | 7 | 6 | 5 | 1 | 0 | 4 | 7 | 6 | 5 | 1 | 0 | 7 | 6 | 1 | 2 | 4 | 7 | 6 | 5 | 3 | 2 | 4 | 7 | 6 | 5 | 3 | 2 | 4 | 7 | 6 | 5 | 3 |
| Weight | 1 | 64 | 32 | 16 | 2 | 1 | 8 | 64 | 32 | 16 | 2 | 1 | 64 | 32 | 2 | 4 | 16 | 64 | 32 | 16 | 8 | 4 | 16 | 64 | 32 | 16 | 8 | 4 | 16 | 64 | 32 | 32 | 8 |

Figure 15B

1508

| Color | R | R | R | R | R | R | R | R | R | R | R | G | G | G | G | G | G | G | G | G | G | G | B | B | B | B | B | B | B | B | B |
|---|---|---|---|---|---|---|---|---|---|---|---|---|---|---|---|---|---|---|---|---|---|---|---|---|---|---|---|---|---|---|---|
| Bit # | 0 | 1 | 2 | 3 | 4 | 5 | 6 | 7 | 8 | 9 | 10 | 0 | 1 | 2 | 3 | 4 | 5 | 6 | 7 | 8 | 9 | 10 | 11 | 0 | 1 | 2 | 3 | 4 | 5 | 6 | 7 | 8 |
| Weight | 1 | 2 | 4 | 8 | 12 | 24 | 40 | 40 | 40 | 42 | 42 | 1 | 2 | 4 | 8 | 12 | 20 | 32 | 32 | 32 | 32 | 40 | 40 | 1 | 2 | 4 | 8 | 16 | 32 | 64 | 64 | 64 |

Figure 15C

1602

| Color | R | R | G | G | B | B | R | R | R | G | G | G | B | B | B | R | R | R | G | G | G | B | B | B |
|---|---|---|---|---|---|---|---|---|---|---|---|---|---|---|---|---|---|---|---|---|---|---|---|---|
| Bit # | 7 | 6 | 7 | 6 | 7 | 6 | 5 | 4 | 3 | 5 | 4 | 3 | 5 | 4 | 3 | 2 | 1 | 0 | 2 | 1 | 0 | 2 | 1 | 0 |
| Weight | 128 | 64 | 128 | 64 | 128 | 64 | 32 | 16 | 8 | 32 | 16 | 8 | 32 | 16 | 8 | 4 | 2 | 1 | 4 | 2 | 1 | 4 | 2 | 1 |

Figure 16A

1604

| Color | R | R | R | R | G | G | G | G | B | B | B | B | R | R | R | R | G | G | G | G | B | B | B | B | R | R | R | R | G | G | G | G | B | B | B | B |
|---|---|---|---|---|---|---|---|---|---|---|---|---|---|---|---|---|---|---|---|---|---|---|---|---|---|---|---|---|---|---|---|---|---|---|---|---|
| Bit # | | | | | 11 | 10 | 9 | 8 | | | | | | | | | 7 | 6 | 5 | 4 | | | | | | | | | 3 | 2 | 1 | 0 | | | | |
| Weight | | | | | 70 | 52 | 38 | 27 | | | | | | | | | 19 | 14 | 12 | 10 | | | | | | | | | 6 | 4 | 2 | 1 | | | | |

Figure 16B

1702

| Color | R | R | R | R | R | R | G | G | G | G | G | G | B | B | B | B | B | B | R | R | R | R | R | R | G | G | G | G | G | G | B | B | B | B | B | B |
|---|---|---|---|---|---|---|---|---|---|---|---|---|---|---|---|---|---|---|---|---|---|---|---|---|---|---|---|---|---|---|---|---|---|---|---|---|
| Bit # | 0 | 4 | 7 | 6 | 5 | 1 | 0 | 4 | 7 | 6 | 5 | 1 | 0 | 4 | 7 | 6 | 5 | 1 | 2 | 4 | 7 | 6 | 5 | 3 | 2 | 4 | 7 | 6 | 5 | 3 | 2 | 4 | 7 | 6 | 5 | 3 |
| Weight | 1 | 8 | 64 | 32 | 16 | 2 | 1 | 8 | 64 | 32 | 16 | 2 | 1 | 8 | 64 | 32 | 16 | 2 | 4 | 8 | 64 | 32 | 16 | 8 | 4 | 8 | 64 | 32 | 16 | 8 | 4 | 8 | 64 | 32 | 16 | 8 |

Figure 17A

1704

| Frame Rate of 30Hz | | | | | | | | | | | | | | | |
|---|---|---|---|---|---|---|---|---|---|---|---|---|---|---|---|
| Bit # | 6 | 7 | 5 | 2 | 3 | 6 | 7 | 4 | 1 | 5 | 6 | 7 | 3 | 0 | 4 |
| Weight | 21 | 43 | 16 | 4 | 4 | 21 | 43 | 8 | 2 | 16 | 21 | 43 | 4 | 1 | 8 |

Figure 17B

1900

| Color | Bit # | Weight |
|---|---|---|
| R | 0 | 1 |
| G | 0 | 1 |
| B | 0 | 1 |
| R | 3 | 8 |
| G | 3 | 8 |
| B | 3 | 8 |
| R | 4 | 16 |
| G | 4 | 16 |
| B | 4 | 16 |
| R | 5 | 32 |
| G | 5 | 32 |
| B | 5 | 32 |
| R | 7 | 128 |
| G | 7 | 128 |
| B | 7 | 128 |
| R | 6 | 64 |
| G | 6 | 64 |
| B | 6 | 64 |
| R | 2 | 4 |
| G | 2 | 4 |
| B | 2 | 4 |
| R | 1 | 2 |
| G | 1 | 2 |
| B | 1 | 2 |
| R | 0 | 1 |
| G | 0 | 1 |
| B | 0 | 1 |
| R | 3 | 8 |
| G | 3 | 8 |
| B | 3 | 8 |
| R | 4 | 16 |
| G | 4 | 16 |
| B | 4 | 16 |
| R | 5 | 32 |
| G | 5 | 32 |
| B | 5 | 32 |
| R | 7 | 128 |
| G | 7 | 128 |
| B | 7 | 128 |
| R | 6 | 64 |
| G | 6 | 64 |
| B | 6 | 64 |
| R | 2 | 4 |
| G | 2 | 4 |
| B | 2 | 4 |
| R | 1 | 2 |
| G | 1 | 2 |
| B | 1 | 2 |
| R | 0 | 1 |
| G | 0 | 1 |
| B | 0 | 1 |
| R | 3 | 8 |
| G | 3 | 8 |
| B | 3 | 8 |
| R | 4 | 16 |
| G | 4 | 16 |
| B | 4 | 16 |
| R | 5 | 32 |
| G | 5 | 32 |
| B | 5 | 32 |
| R | 7 | 128 |
| G | 7 | 128 |
| B | 7 | 128 |
| R | 6 | 64 |
| G | 6 | 64 |
| B | 6 | 64 |
| R | 2 | 4 |
| G | 2 | 4 |
| B | 2 | 4 |
| R | 1 | 2 |
| G | 1 | 2 |
| B | 1 | 2 |
| R | 0 | 1 |
| G | 0 | 1 |
| B | 0 | 1 |

Frame 1

Frame 2

Figure 19

2000

| Color | Bit # | Weight |
|---|---|---|
| R | 0 | 1 |
| R | 4 | 8 |
| R | 7 | 64 |
| R | 6 | 32 |
| R | 5 | 16 |
| R | 1 | 2 |
| G | 0 | 1 |
| G | 4 | 8 |
| G | 7 | 64 |
| G | 6 | 32 |
| G | 5 | 16 |
| G | 1 | 2 |
| B | 0 | 1 |
| B | 4 | 8 |
| B | 7 | 64 |
| B | 6 | 32 |
| B | 5 | 16 |
| B | 1 | 2 |
| R | 2 | 4 |
| R | 4 | 8 |
| R | 7 | 64 |
| R | 6 | 32 |
| R | 5 | 16 |
| R | 3 | 8 |
| G | 2 | 4 |
| G | 4 | 8 |
| G | 7 | 64 |
| G | 6 | 32 |
| G | 5 | 16 |
| G | 3 | 8 |
| B | 2 | 4 |
| B | 4 | 8 |
| B | 7 | 64 |
| B | 6 | 32 |
| B | 5 | 16 |
| B | 3 | 8 |

Figure 20

2102

| Color | Bit # | Weight |
|---|---|---|
| R | 0 | 1 |
| R | 1 | 2 |
| R | 2 | 4 |
| R | 3 | 8 |
| G | 4 | 8 |
| G | 7 | 32 |
| G | 6 | 16 |
| G | 5 | 16 |
| B | 4 | 16 |
| B | 5 | 32 |
| B | 6 | 64 |
| B | 7 | 128 |
| G | 0 | 1 |
| G | 7 | 32 |
| G | 6 | 16 |
| G | 1 | 2 |
| R | 4 | 16 |
| R | 5 | 32 |
| R | 6 | 64 |
| R | 7 | 128 |
| G | 4 | 8 |
| G | 7 | 32 |
| G | 6 | 16 |
| G | 5 | 16 |
| B | 0 | 1 |
| B | 1 | 2 |
| B | 2 | 4 |
| B | 3 | 8 |
| G | 2 | 4 |
| G | 7 | 32 |
| G | 6 | 16 |
| G | 3 | 8 |

Figure 21A

2104

| Color | Bit # | Weight |
|---|---|---|
| B | 3 | 8 |
| B | 9 | 32 |
| R | 3 | 8 |
| R | 9 | 32 |
| B | 6 | 20 |
| R | 6 | 20 |
| B | 1 | 2 |
| R | 1 | 2 |
| G | 3 | 8 |
| G | 9 | 32 |
| R | 2 | 4 |
| G | 6 | 20 |
| G | 1 | 2 |
| G | 2 | 4 |
| R | 0 | 1 |
| B | 2 | 4 |
| G | 0 | 1 |
| G | 4 | 8 |
| G | 5 | 12 |
| B | 0 | 1 |
| G | 7 | 20 |
| G | 8 | 20 |
| R | 4 | 8 |
| R | 5 | 12 |
| B | 4 | 8 |
| B | 5 | 12 |
| B | 7 | 20 |
| R | 7 | 20 |
| R | 8 | 20 |
| B | 8 | 20 |

Figure 21B

2202

| Color | Bit # | Weight |
|---|---|---|
| R | 7 | 26 |
| R | 5 | 24 |
| B | 7 | 26 |
| B | 5 | 24 |
| R | 3 | 8 |
| R | 2 | 4 |
| R | 0 | 1 |
| R | 1 | 2 |
| R | 4 | 12 |
| B | 3 | 8 |
| R | 6 | 24 |
| R | 8 | 26 |
| G | 7 | 26 |
| G | 5 | 24 |
| B | 2 | 4 |
| G | 3 | 8 |
| G | 2 | 4 |
| G | 0 | 1 |
| G | 1 | 2 |
| G | 4 | 12 |
| B | 0 | 1 |
| B | 1 | 2 |
| B | 4 | 12 |
| G | 6 | 24 |
| G | 8 | 26 |
| B | 6 | 24 |
| B | 8 | 26 |

Figure 22

2400

| Color | Bit # | Weight |
|---|---|---|
| R | 8 | 80 |
| R | 6 | 32 |
| R | 4 | 16 |
| R | 0 | 1 |
| R | 1 | 2 |
| R | 2 | 4 |
| R | 3 | 8 |
| R | 5 | 32 |
| R | 7 | 80 |
| G | 8 | 64 |
| G | 6 | 40 |
| G | 4 | 16 |
| G | 0 | 2 |
| G | 1 | 1 |
| G | 2 | 4 |
| G | 3 | 8 |
| G | 5 | 16 |
| G | 7 | 40 |
| G | 9 | 64 |
| B | 8 | 80 |
| B | 6 | 32 |
| B | 4 | 16 |
| B | 0 | 1 |
| B | 1 | 2 |
| B | 2 | 4 |
| B | 3 | 8 |
| B | 5 | 32 |
| B | 7 | 80 |
| W | 8 | 80 |
| W | 6 | 32 |
| W | 4 | 16 |
| W | 0 | 1 |
| W | 1 | 2 |
| W | 2 | 4 |
| W | 3 | 8 |
| W | 5 | 32 |
| W | 7 | 80 |

Figure 24

DISPLAY DEVICES AND METHODS FOR GENERATING IMAGES THEREON

CROSS-REFERENCE TO RELATED APPLICATIONS

This application claims the benefit of U.S. Provisional Patent Application Nos. 61/485,990 and 61/551,345, filed on May 13, 2011 and Oct. 25, 2011, respectively. The contents of each of these applications are incorporated by reference herein in their entirety.

TECHNICAL FIELD

This disclosure relates to displays. In particular, this disclosure relates to techniques for reducing image artifacts associated with displays.

DESCRIPTION OF THE RELATED TECHNOLOGY

Certain display apparatus have been implemented that use an image formation process that generates a combination of separate color subframe images (sometimes referred to as subfield), which the mind blends together to form a single image frame RGBW image formation processes are particularly, though not exclusively, useful for field sequential color (FSC) displays, i.e., displays in which the separate color subframes are displayed in sequence, one color at a time. Examples of such displays include micromirror displays and digital shutter based displays. Other displays, such as liquid crystal displays (LCDs) and organic light emitting diode (OLED) displays, which show color subframes simultaneously using separate light modulators or light emitting elements, also may implement RGBW image formation processes. Two image artifacts many FSC displays suffer from include dynamic false contouring (DFC) and color break-up (CBU). These artifacts are generally attributable to an uneven temporal distribution of light of the same (DFC) or different (CBU) colors reaching the eye for a given image frame.

DFC results from situations whereby a small change in luminance level creates a large change in the temporal distribution of outputted light. In turn, the motion of either the eye or the area of interest causes a significant change in temporal distribution of light on the eye. This causes a significant distribution of light intensity in the fovea area of the retina during relative motion between the eye and the area of interest in a displayed image, thereby resulting in DFC.

Viewers are more likely to perceive image artifacts, particularly DFC, resulting from the temporal distribution of certain colors more so than from other colors. In other words, the degree to which the image artifacts are perceptible to an observer varies on the color being generated. It has been observed that the human visual system (HVS) is more sensitive to the color green than it is to either red or blue. As such, an observer can more readily perceive image artifacts from gaps in the temporal distribution of green light than for red or blue light.

SUMMARY

The systems, methods and devices of the disclosure each have several innovative aspects, no single one of which is solely responsible for the desirable attributes disclosed herein.

One innovative aspect of the subject matter described in this disclosure can be implemented in a display apparatus having a plurality of pixels and a controller. The controller is configured to cause the pixels of the display apparatus to generate respective colors corresponding to an image frame. In some implementations, the controller can cause the display apparatus to display the image frame using sets of subframe images corresponding to a plurality of contributing colors according to a field sequential color (FSC) image formation process. The contributing colors include a plurality of component colors and at least one composite color. The composite color corresponds to a color that is substantially a combination of at least two of the plurality of component colors. The composite color can include at least one of white or yellow and the component colors can include red, green and blue. In other implementations, the display apparatus uses a different set of 4 contributing colors, e.g., cyan, yellow, magenta, and white, where white is a composite color, and cyan, yellow, and magenta are component colors. In some implementations, the display apparatus uses 5 or more contributing colors, e.g., red, green, blue, cyan, and yellow. In some of such implementations, yellow is a considered a composite color having component colors of red and green. In others of such implementations, cyan is considered a composite color having component colors of yellow, green, and blue. The display apparatus, in displaying an image frame, is caused to display a greater number of subframe images corresponding to a first component color relative to a number of subframe images corresponding to a second component color. The first component color can be green. For at least a first contributing color of the contributing colors, the display apparatus is configured to output a given luminance of the first contributing color for a first pixel by generating a first set of pixel states and output the same luminance of the first component color for a second pixel by generating a second, different set of pixel states. The display apparatus can include a memory configured to store a first lookup table and a second lookup table including a plurality of sets of pixel states for a luminance level. In such implementations, the controller can derive the first set of pixel states using the first lookup table and the second set of pixel states using the second lookup table. In some implementations, the memory can store a plurality of imaging modes that correspond to a plurality to subframe sequences and the controller can select an imaging mode and a corresponding subframe sequence.

Another innovative aspect of the subject matter described in this disclosure can be implemented in a controller configured to cause a plurality of pixels of a display apparatus to generate respective colors corresponding to an image frame. In some implementations, the controller can cause the display apparatus to display the image frame using sets of subframe images corresponding to a plurality of contributing colors according to a FSC image formation process. The contributing colors include a plurality of component colors and at least one composite color. The composite color corresponds to a color that is substantially a combination of at least two of the plurality of component colors. The composite color can include at least one of white or yellow and the component colors can include red, green and blue. In other implementations, the display apparatus uses a different set of 4 contributing colors, e.g., cyan, yellow, magenta, and white, where white is a composite color, and cyan, yellow, and magenta are component colors. In some implementations, the display apparatus uses 5 or more contributing colors, e.g., red, green, blue, cyan, and yellow. In some of such implementations, yellow is a considered a composite color having component colors of red and green. In others of such implementations, cyan is considered a composite color having component colors of yellow, green, and blue. The display apparatus, in displaying an image frame, is caused to display a greater number of subframe images corresponding to a first component color relative to a number of subframe images corresponding to a second component color. The first component color can be green. For at least a first contributing color of the contributing colors, the display apparatus is configured to output a given luminance of the first contributing color for a first pixel by generating a first set of pixel states and output the same luminance of the first component color for a second pixel by generating a second, different set of pixel states. The controller can include a memory configured to store a first lookup table and a second lookup table including a plurality of sets of pixel states for a luminance level. In such implementations, the controller can derive the first set of pixel states using the first lookup table and the second set of pixel states using the second lookup table. In some implementations, the memory can store a plurality of imaging modes that correspond to a plurality to subframe sequences and the controller can select an imaging mode and a corresponding subframe sequence.

Another innovative aspect of the subject matter described in this disclosure can be implemented in a method for displaying an image frame on a display apparatus. The method includes causing a plurality of pixels of a display apparatus to generate respective colors corresponding to an image frame. In some implementations, the controller can cause the display apparatus to display the image frame using sets of subframe images corresponding to a plurality of contributing colors according to a FSC image formation process. The contributing colors include a plurality of component colors and at least one composite color. The composite color corresponds to a color that is substantially a combination of at least two of the plurality of component colors. The composite color can include at least one of white or yellow and the component colors can include red, green and blue. In other implementations, the display apparatus uses a different set of 4 contributing colors, e.g., cyan, yellow, magenta, and white, where white is a composite color, and cyan, yellow, and magenta are component colors. In some implementations, the display apparatus uses 5 or more contributing colors, e.g., red, green, blue, cyan, and yellow. In some of such implementations, yellow is a considered a composite color having component colors of red and green. In others of such implementations, cyan is considered a composite color having component colors of yellow, green, and blue. The display apparatus, in displaying an image frame, is caused to display a greater number of subframe images corresponding to a first component color relative to a number of subframe images corresponding to a second component color. The first component color can be green. For at least a first contributing color of the contributing colors, the display apparatus is configured to output a given luminance of the first contributing color for a first pixel by generating a first set of pixel states and output the same luminance of the first component color for a second pixel by generating a second, different set of pixel states. The controller can include a memory configured to store a first lookup table and a second lookup table including a plurality of sets of pixel states for a luminance level. In such implementations, the controller can derive the first set of pixel states using the first lookup table and the second set of pixel states using the second lookup table. In some implementations, the memory can store a plurality of imaging modes that correspond to a plurality to subframe sequences and the controller can select an imaging mode and a corresponding subframe sequence.

Details of one or more implementations of the subject matter described in this specification are set forth in the accompanying drawings and the description below. Although the examples provided in this summary are primarily described in terms of MEMS-based displays, the concepts provided herein may apply to other types of displays, such as LCD, OLED, electrophoretic, and field emission displays. Other features, aspects, and advantages will become apparent from the description, the drawings, and the claims. Note that the relative dimensions of the following figures may not be drawn to scale.

BRIEF DESCRIPTION OF THE DRAWINGS

FIG. 10 shows an example luminance level lookup table (LLLT) suitable for use in implementing an 8-bit binary weighting scheme.

FIG. 11 shows an example LLLT suitable for use in implementing a 12-bit non-binary weighting scheme.

FIG. 12A shows an example portion of a display depicting a technique for reducing DFC by concurrently generating the same luminance level at two pixels using different combinations of pixel states.

FIG. 12B shows an example LLLT suitable for use in generating the display of FIG. 12A.

FIG. 12C shows an example portion of a display depicting a technique for reducing DFC by concurrently generating the same luminance level at four pixels using different combinations of pixel states.

FIG. 12D shows two example charts graphically depicting the contents of two LLLTs described in relation to FIG. 12C.

FIG. 12E shows an example portion of a display depicting a technique, particularly suited for higher pixel-per-inch (PPI) display apparatus, for reducing DFC by concurrently generating the same luminance level at four pixels using different combinations of pixel states.

FIG. 13 shows two example tables setting forth subframe sequences suitable for employing a process for spatially varying the code words used to generate pixel values on a display apparatus.

FIG. 15A shows an example table setting forth a subframe sequence having different bit arrangements for different contributing colors.

FIG. 15B shows an example table setting forth a subframe sequence corresponding to a binary weighting scheme in which different numbers of bits are split for different contributing colors.

FIG. 15C shows an example table setting forth a subframe sequence corresponding to a non-binary weighting scheme in which different numbers of bits are split for different contributing colors.

FIG. 16A shows an example table setting forth a subframe sequence having an increased color change frequency.

FIG. 16B shows an example table setting forth a subframe sequence for a field sequential color display employing a 12-bit per color non-binary code word.

FIG. 17A shows an example table setting forth a subframe sequence for reducing flicker by employing different frame rates for different bits.

FIG. 17B shows an example table setting forth a portion of a subframe sequence for reducing flicker by reducing a frame rate below a threshold frame rate.

FIG. 19 shows an example table setting forth a two-frame subframe sequence that alternates between use of two different weighting schemes through a series of image frames.

FIG. 20 shows an example table setting forth a subframe sequence combining a variety of techniques for mitigating DFC, CBU and flicker.

FIG. 21A shows an example table setting forth a subframe sequence for mitigating DFC, CBU, and flicker by grouping bits of a first color after each grouping of bits of one of the other colors.

FIG. 21B shows an example table setting forth a similar subframe sequence for mitigating DFC, CBU, and flicker by grouping bits of a first color after each grouping of bits of one of the other colors corresponding to a non-binary weighting scheme.

FIG. 22 shows an example table setting forth a subframe sequence for mitigating DFC, CBU, and flicker by employing an arrangement in which the number of separate groups of contiguous bits for a first color is greater than the number of separate groups of contiguous bits for other colors.

FIG. 24 shows an example table setting forth a subframe sequence for reducing image artifacts using a non-binary weighting scheme for a four color imaging mode that provides extra bits to one of the contributing colors.

DETAILED DESCRIPTION

Figure 1A:
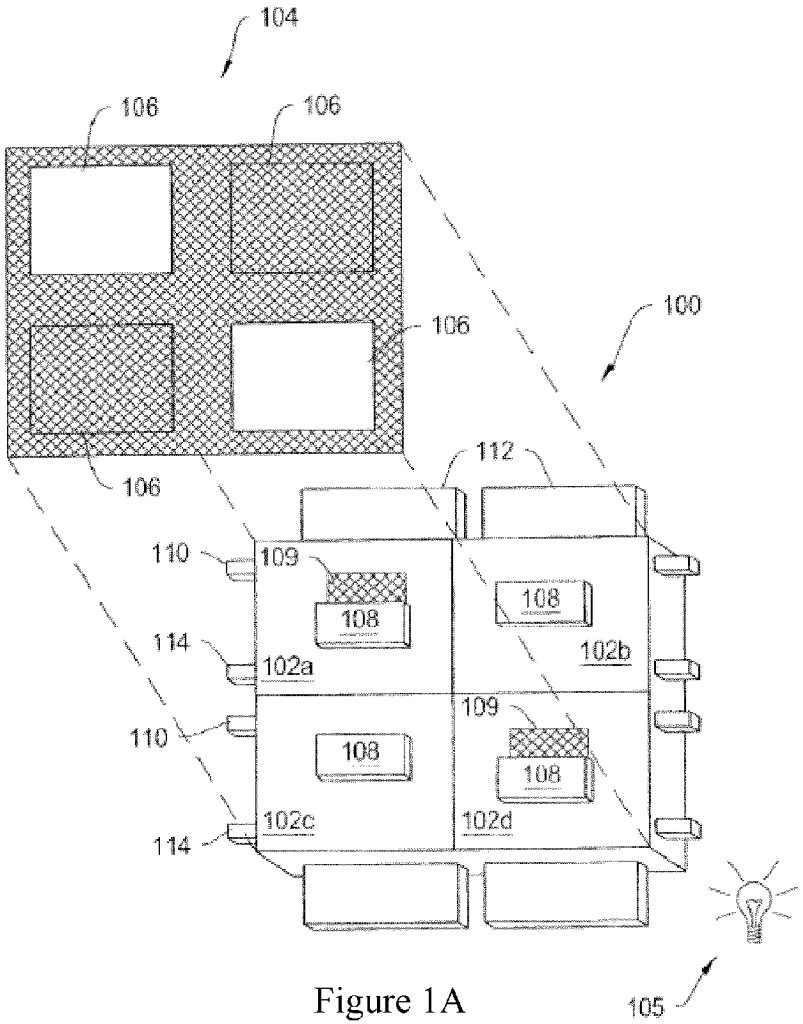
FIG. 1A shows an example schematic diagram of a direct-view MEMS-based display apparatus.

This disclosure relates to image formation techniques for reducing image artifacts, such as DFC, CBU and flicker. In operation, a display device can select from a variety of imaging modes corresponding to one or more of the image formation techniques. Each imaging mode corresponds to at least one subframe sequence and at least one corresponding set of weighting schemes. A weighting scheme corresponds to the weight and number of distinct subframe images used to generate the range of luminance levels the display device will be able to display. A subframe sequence defines the actual order in which all subframe images for all colors will be output on the display device or apparatus. According to implementations described herein, outputting images using appropriate subframe sequences, which correspond to various image formation techniques, can improve image quality and reduce image artifacts. In particular, example techniques involve the use of non-binary weighting schemes that provide multiple, different (or "degenerate") combinations of pixel states to represent a particular luminance level of a contributing color. The non-binary weighting schemes can further be used to spatially and/or temporally vary the combinations of pixel states used for a same given luminance level of a color. Other techniques involve the use of different number of subframes for different contributing colors either by bit splitting or varying their respective bit depths. In some techniques, subframe images having the largest weights can be placed towards the center of the subframe sequence. In some other techniques, the subframe images having larger weights are arranged in close proximity with one another, for e.g., a subframe image with the largest weight is separated from the subframe image with the second largest weight by no more than 3 other subframe images.

Particular implementations of the subject matter described in this disclosure can be implemented to realize one or more of the following potential advantages. As described above, outputting images using appropriate subframe sequences, which correspond to various image formation techniques, can improve image quality and reduce the incidence and severity of image artifacts including DFC, CBU and/or flicker. In addition, some implementations reduce the perceptual significance of noise energy by spreading the spectral distribution of noise energy. Another advantage of some implementations includes a reduction in the amount of electrical power being consumed by a display implementing the methods disclosed herein.

The display apparatus disclosed herein mitigates the occurrence of DFC in an image by focusing on those colors to which the human eye is most sensitive, e.g., green. Accordingly, the display apparatus displays a greater number of subframe images corresponding to a first color relative to the number of subframe images corresponding to a second color. Moreover, the display apparatus can output a particular luminance value for a contributing color (red, green, blue, or white) using multiple, different (or "degenerate") sequences of pixel states. Providing degeneracy allows the display apparatus to select a particular sequence of pixel states that reduces the perception of image artifacts, without causing image degradation. By allocating more subframe images, and thus the potential for greater degeneracy in displaying the colors the human eye is more sensitive to, the display apparatus has greater flexibility to select a set of pixel states for an image that reduces DFC.

FIG. 1A shows a schematic diagram of a direct-view MEMS-based display apparatus 100. The display apparatus 100 includes a plurality of light modulators 102*a*-102*d* (generally "light modulators 102") arranged in rows and columns. In the display apparatus 100, the light modulators 102*a* and 102*d* are in the open state, allowing light to pass. The light modulators 102*b* and 102*c* are in the closed state, obstructing the passage of light. By selectively setting the states of the light modulators 102*a*-102*d*, the display apparatus 100 can be utilized to form an image 104 for a backlit display, if illuminated by a lamp or lamps 105. In another implementation, the apparatus 100 may form an image by reflection of ambient light originating from the front of the apparatus. In another implementation, the apparatus 100 may form an image by reflection of light from a lamp or lamps positioned in the front of the display, i.e., by use of a front light.

In some implementations, each light modulator 102 corresponds to a pixel 106 in the image 104. In some other implementations, the display apparatus 100 may utilize a plurality of light modulators to form a pixel 106 in the image 104. For example, the display apparatus 100 may include three color-specific light modulators 102. By selectively opening one or more of the color-specific light modulators 102 corresponding to a particular pixel 106, the display apparatus 100 can generate a color pixel 106 in the image 104. In another example, the display apparatus 100 includes two or more light modulators 102 per pixel 106 to provide luminance level in an image 104. With respect to an image, a "pixel" corresponds to the smallest picture element defined by the resolution of image. With respect to structural components of the display apparatus 100, the term "pixel" refers to the combined mechanical and electrical components utilized to modulate the light that forms a single pixel of the image.

The display apparatus 100 is a direct-view display in that it may not include imaging optics typically found in projection applications. In a projection display, the image formed on the surface of the display apparatus is projected onto a screen or onto a wall. The display apparatus is substantially smaller than the projected image. In a direct view display, the user sees the image by looking directly at the display apparatus, which contains the light modulators and optionally a backlight or front light for enhancing brightness and/or contrast seen on the display.

Direct-view displays may operate in either a transmissive or reflective mode. In a transmissive display, the light modulators filter or selectively block light which originates from a lamp or lamps positioned behind the display. The light from the lamps is optionally injected into a lightguide or "backlight" so that each pixel can be uniformly illuminated. Transmissive direct-view displays are often built onto transparent or glass substrates to facilitate a sandwich assembly arrangement where one substrate, containing the light modulators, is positioned directly on top of the backlight.

Each light modulator 102 can include a shutter 108 and an aperture 109. To illuminate a pixel 106 in the image 104, the shutter 108 is positioned such that it allows light to pass through the aperture 109 towards a viewer. To keep a pixel 106 unlit, the shutter 108 is positioned such that it obstructs the passage of light through the aperture 109. The aperture 109 is defined by an opening patterned through a reflective or light-absorbing material in each light modulator 102.

The display apparatus also includes a control matrix connected to the substrate and to the light modulators for controlling the movement of the shutters. The control matrix includes a series of electrical interconnects (e.g., interconnects 110, 112 and 114), including at least one write-enable interconnect 110 (also referred to as a "scan-line interconnect") per row of pixels, one data interconnect 112 for each column of pixels, and one common interconnect 114 providing a common voltage to all pixels, or at least to pixels from both multiple columns and multiples rows in the display apparatus 100. In response to the application of an appropriate voltage (the "write-enabling voltage, $V_{WE}$"), the write-enable interconnect 110 for a given row of pixels prepares the pixels in the row to accept new shutter movement instructions. The data interconnects 112 communicate the new movement instructions in the form of data voltage pulses. The data voltage pulses applied to the data interconnects 112, in some implementations, directly contribute to an electrostatic movement of the shutters. In some other implementations, the data voltage pulses control switches, e.g., transistors or other non-linear circuit elements that control the application of separate actuation voltages, which are typically higher in magnitude than the data voltages, to the light modulators 102. The application of these actuation voltages then results in the electrostatic driven movement of the shutters 108.

Figure 1B:
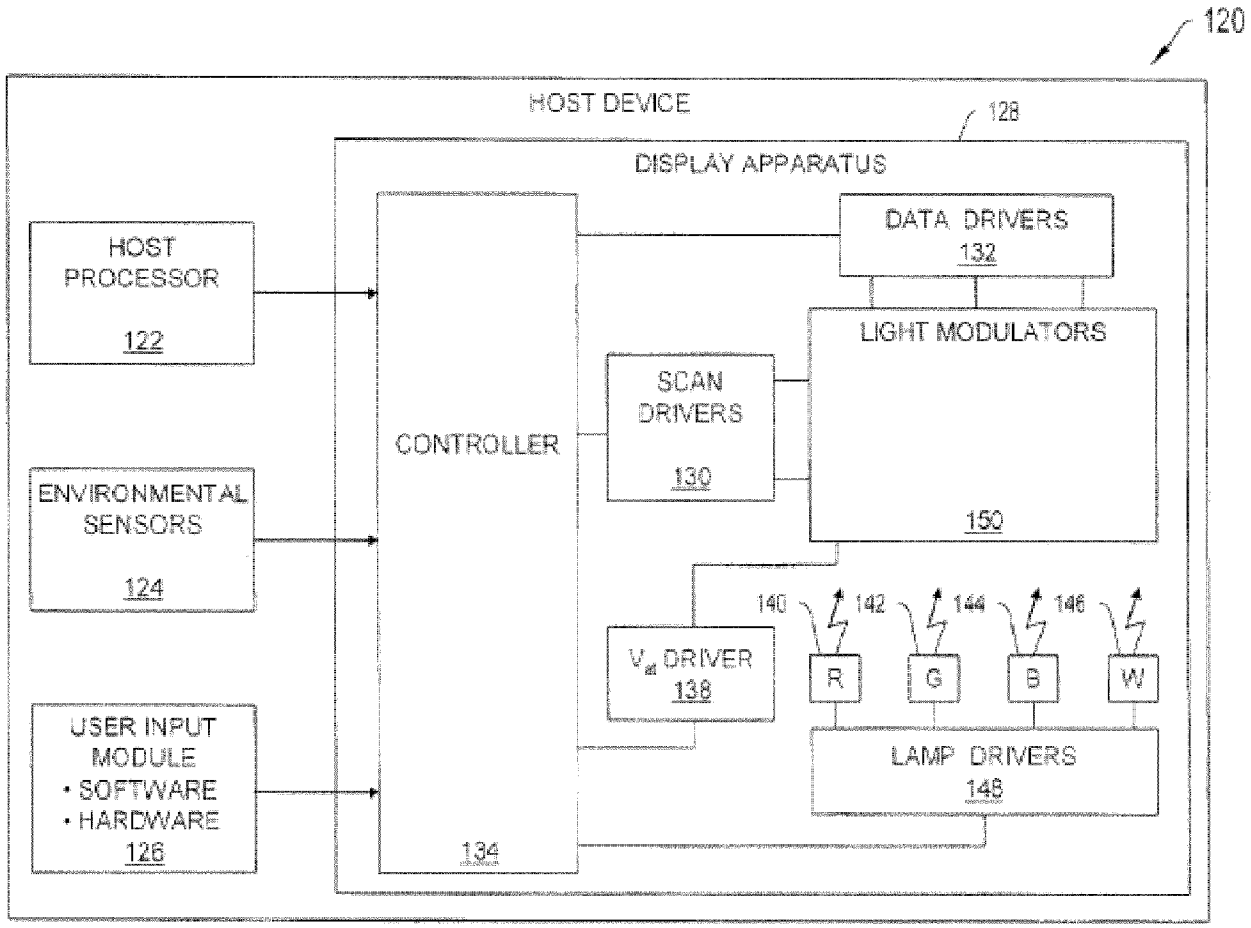
FIG. 1B shows an example block diagram of a host device.

FIG. 1B shows an example of a block diagram 120 of a host device (i.e., cell phone, smart phone, PDA, MP3 player, tablet, e-reader, etc.). The host device includes a display apparatus 128, a host processor 122, environmental sensors 124, a user input module 126, and a power source.

The display apparatus 128 includes a plurality of scan drivers 130 (also referred to as "write enabling voltage sources"), a plurality of data drivers 132 (also referred to as "data voltage sources"), a controller 134, common drivers 138, lamps 140-146, and lamp drivers 148. The scan drivers 130 apply write enabling voltages to scan-line interconnects 110. The data drivers 132 apply data voltages to the data interconnects 112.

In some implementations of the display apparatus, the data drivers 132 are configured to provide analog data voltages to the light modulators, especially where the luminance level of the image 104 is to be derived in analog fashion. In analog operation, the light modulators 102 are designed such that when a range of intermediate voltages is applied through the data interconnects 112, there results a range of intermediate open states in the shutters 108 and therefore a range of intermediate illumination states or luminance levels in the image 104. In other cases, the data drivers 132 are configured to apply only a reduced set of 2, 3, or 4 digital voltage levels to the data interconnects 112. These voltage levels are designed to set, in digital fashion, an open state, a closed state, or other discrete state to each of the shutters 108.

The scan drivers 130 and the data drivers 132 are connected to a digital controller circuit 134 (also referred to as the "controller 134"). The controller sends data to the data drivers 132 in a mostly serial fashion, organized in predetermined sequences grouped by rows and by image frames. The data drivers 132 can include series to parallel data converters, level shifting, and for some applications digital to analog voltage converters.

The display apparatus optionally includes a set of common drivers 138, also referred to as common voltage sources. In some implementations, the common drivers 138 provide a DC common potential to all light modulators within the array of light modulators, for instance by supplying voltage to a series of common interconnects 114. In some other implementations, the common drivers 138, following commands from the controller 134, issue voltage pulses or signals to the array of light modulators, for instance global actuation pulses which are capable of driving and/or initiating simultaneous actuation of all light modulators in multiple rows and columns of the array.

All of the drivers (e.g., scan drivers 130, data drivers 132, and common drivers 138) for different display functions are time-synchronized by the controller 134. Timing commands from the controller coordinate the illumination of red, green and blue and white lamps (140, 142, 144 and 146 respectively) via lamp drivers 148, the write-enabling and sequencing of specific rows within the array of pixels, the output of voltages from the data drivers 132, and the output of voltages that provide for light modulator actuation.

The controller 134 determines the sequencing or addressing scheme by which each of the shutters 108 can be re-set to the illumination levels appropriate to a new image 104. New images 104 can be set at periodic intervals. For instance, for video displays, the color images 104 or frames of video are refreshed at frequencies ranging from 10 to 300 Hertz. In some implementations the setting of an image frame to the array is synchronized with the illumination of the lamps 140, 142, 144 and 146 such that alternate image frames are illuminated with an alternating series of colors, such as red, green, and blue. The image frames for each respective color is referred to as a color subframe. In this method, referred to as the field sequential color method, if the color subframes are alternated at frequencies in excess of 20 Hz, the human brain will average the alternating frame images into the perception of an image having a broad and continuous range of colors. In alternate implementations, four or more lamps with primary colors can be employed in display apparatus 100, employing primaries other than red, green, and blue.

In some implementations, where the display apparatus 100 is designed for the digital switching of shutters 108 between open and closed states, the controller 134 forms an image by the method of time division gray scale, as previously described. In some other implementations, the display apparatus 100 can provide gray scale through the use of multiple shutters 108 per pixel.

In some implementations the data for an image state 104 is loaded by the controller 134 to the modulator array by a sequential addressing of individual rows, also referred to as scan lines. For each row or scan line in the sequence, the scan driver 130 applies a write-enable voltage to the write enable interconnect 110 for that row of the array, and subsequently the data driver 132 supplies data voltages, corresponding to desired shutter states, for each column in the selected row. This process repeats until data has been loaded for all rows in the array. In some implementations, the sequence of selected rows for data loading is linear, proceeding from top to bottom in the array. In some other implementations, the sequence of selected rows is pseudo-randomized, in order to minimize visual artifacts. And in other implementations the sequencing is organized by blocks, where, for a block, the data for only a certain fraction of the image state 104 is loaded to the array, for instance by addressing only every $5^{th}$ row of the array in sequence.

In some implementations, the process for loading image data to the array is separated in time from the process of actuating the shutters 108. In these implementations, the modulator array may include data memory elements for each pixel in the array and the control matrix may include a global actuation interconnect for carrying trigger signals, from common driver 138, to initiate simultaneous actuation of shutters 108 according to data stored in the memory elements.

In alternative implementations, the array of pixels and the control matrix that controls the pixels may be arranged in configurations other than rectangular rows and columns. For example, the pixels can be arranged in hexagonal arrays or curvilinear rows and columns. In general, as used herein, the term scan-line shall refer to any plurality of pixels that share a write-enabling interconnect.

The host processor 122 generally controls the operations of the host. For example, the host processor may be a general or special purpose processor for controlling a portable electronic device. With respect to the display apparatus 128, included within the host device 120, the host processor outputs image data as well as additional data about the host. Such information may include data from environmental sensors, such as ambient light or temperature; information about the host, including, for example, an operating mode of the host or the amount of power remaining in the host's power source; information about the content of the image data; information about the type of image data; and/or instructions for display apparatus for use in selecting an imaging mode.

The user input module 126 conveys the personal preferences of the user to the controller 134, either directly, or via the host processor 122. In some implementations, the user input module is controlled by software in which the user programs personal preferences such as "deeper color," "better contrast," "lower power," "increased brightness," "sports," "live action," or "animation." In some other implementations, these preferences are input to the host using hardware, such as a switch or dial. The plurality of data inputs to the controller 134 direct the controller to provide data to the various drivers 130, 132, 138 and 148 which correspond to optimal imaging characteristics.

An environmental sensor module 124 also can be included as part of the host device. The environmental sensor module receives data about the ambient environment, such as temperature and or ambient lighting conditions. The sensor module 124 can be programmed to distinguish whether the device is operating in an indoor or office environment versus an outdoor environment in bright daylight versus and outdoor environment at nighttime. The sensor module communicates this information to the display controller 134, so that the controller can optimize the viewing conditions in response to the ambient environment.

Figure 2A:
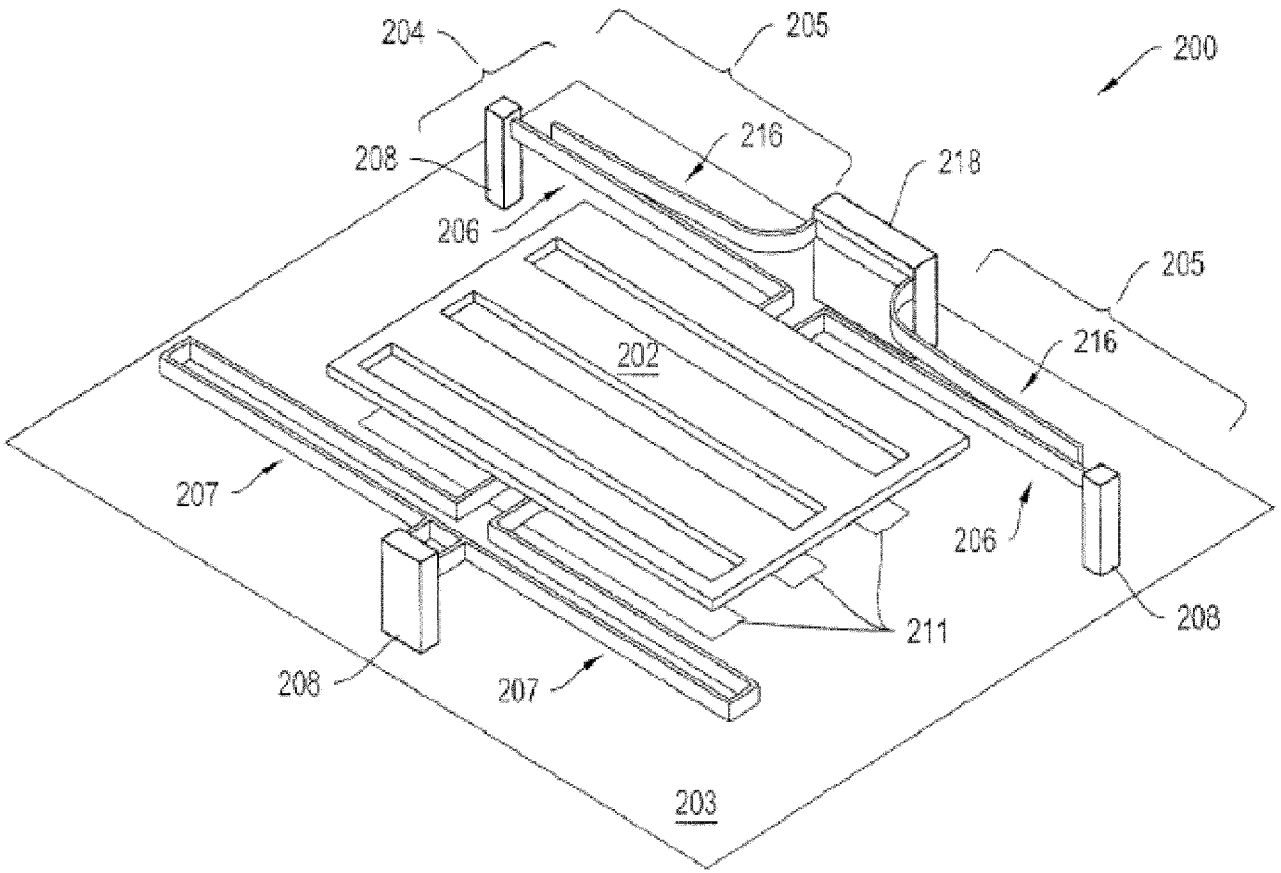
FIG. 2A shows an example perspective view of an illustrative shutter-based light modulator suitable for incorporation into the direct-view MEMS-based display apparatus of FIG. 1A.

FIG. 2A shows a perspective view of an illustrative shutter-based light modulator 200 suitable for incorporation into the direct-view MEMS-based display apparatus 100 of FIG. 1A. The light modulator 200 includes a shutter 202 coupled to an actuator 204. The actuator 204 can be formed from two separate compliant electrode beam actuators 205 (the "actuators" 205. The shutter 202 couples on one side to the actuators 205. The actuators 205 move the shutter 202 transversely over a surface 203 in a plane of motion which is substantially parallel to the surface 203. The opposite side of the shutter 202 couples to a spring 207 which provides a restoring force opposing the forces exerted by the actuator 204.

Each actuator 205 includes a compliant load beam 206 connecting the shutter 202 to a load anchor 208. The load anchors 208 along with the compliant load beams 206 serve as mechanical supports, keeping the shutter 202 suspended proximate to the surface 203. The surface includes one or more aperture holes 211 for admitting the passage of light. The load anchors 208 physically connect the compliant load beams 206 and the shutter 202 to the surface 203 and electrically connect the load beams 206 to a bias voltage, in some instances, ground.

If the substrate is opaque, such as silicon, then aperture holes 211 are formed in the substrate by etching an array of holes through the substrate 204. If the substrate 204 is transparent, such as glass or plastic, then the first block of the processing sequence involves depositing a light blocking layer onto the substrate and etching the light blocking layer into an array of holes 211. The aperture holes 211 can be generally circular, elliptical, polygonal, serpentine, or irregular in shape.

Each actuator 205 also includes a compliant drive beam 216 positioned adjacent to each load beam 206. The drive beams 216 couple at one end to a drive beam anchor 218 shared between the drive beams 216. The other end of each drive beam 216 is free to move. Each drive beam 216 is curved such that it is closest to the load beam 206 near the free end of the drive beam 216 and the anchored end of the load beam 206.

In operation, a display apparatus incorporating the light modulator 200 applies an electric potential to the drive beams 216 via the drive beam anchor 218. A second electric potential may be applied to the load beams 206. The resulting potential difference between the drive beams 216 and the load beams 206 pulls the free ends of the drive beams 216 towards the anchored ends of the load beams 206, and pulls the shutter ends of the load beams 206 toward the anchored ends of the drive beams 216, thereby driving the shutter 202 transversely towards the drive anchor 218. The compliant members 206 act as springs, such that when the voltage across the beams 206 and 216 potential is removed, the load beams 206 push the shutter 202 back into its initial position, releasing the stress stored in the load beams 206.

A light modulator, such as light modulator 200, incorporates a passive restoring force, such as a spring, for returning a shutter to its rest position after voltages have been removed. Other shutter assemblies can incorporate a dual set of "open" and "closed" actuators and a separate sets of "open" and "closed" electrodes for moving the shutter into either an open or a closed state.

There are a variety of methods by which an array of shutters and apertures can be controlled via a control matrix to produce images, in many cases moving images, with appropriate luminance level. In some cases control is accomplished by means of a passive matrix array of row and column interconnects connected to driver circuits on the periphery of the display. In other cases it is appropriate to include switching and/or data storage elements within each pixel of the array (the so-called active matrix) to improve the speed, the luminance level and/or the power dissipation performance of the display.

Figure 2B:
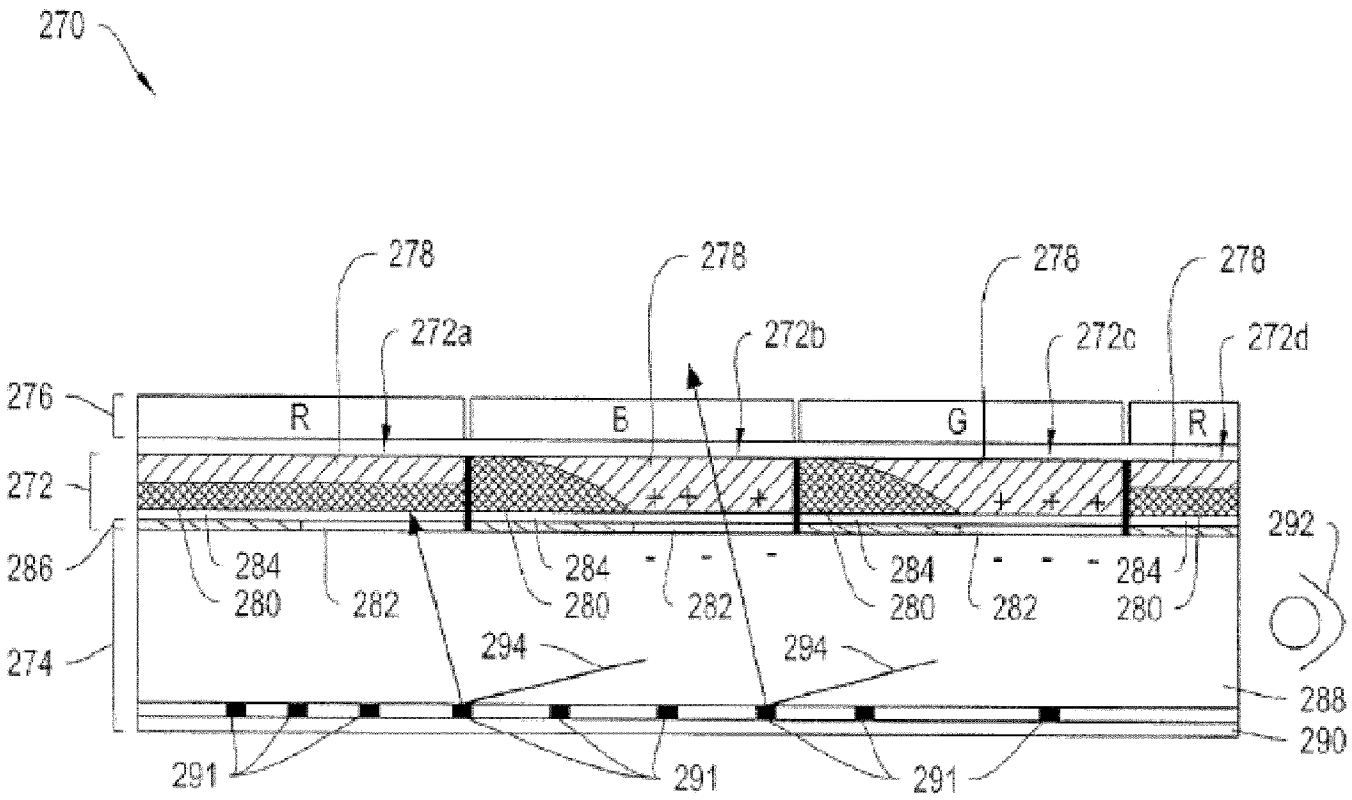
FIG. 2B shows an example cross sectional view of an illustrative non-shutter-based light modulator.

The controller functions described herein are not limited to controlling shutter-based MEMS light modulators, such as the light modulators described above. FIG. 2B is a cross sectional view of an illustrative non-shutter-based light modulator suitable for inclusion in various implementations of the present disclosure. Specifically, FIG. 2B is a cross sectional view of an electrowetting-based light modulation array 270. The light modulation array 270 includes a plurality of electrowetting-based light modulation cells 272*a-d* (generally "cells 272") formed on an optical cavity 274. The light modulation array 270 also includes a set of color filters 276 corresponding to the cells 272.

Each cell 272 includes a layer of water (or other transparent conductive or polar fluid) 278, a layer of light absorbing oil 280, a transparent electrode 282 (made, for example, from indium-tin oxide) and an insulating layer 284 positioned between the layer of light absorbing oil 280 and the transparent electrode 282. In the implementation described herein, the electrode takes up a portion of a rear surface of a cell 272.

The remainder of the rear surface of a cell 272 is formed from a reflective aperture layer 286 that forms the front surface of the optical cavity 274. The reflective aperture layer 286 is formed from a reflective material, such as a reflective metal or a stack of thin films forming a dielectric mirror. For each cell 272, an aperture is formed in the reflective aperture layer 286 to allow light to pass through. The electrode 282 for the cell is deposited in the aperture and over the material forming the reflective aperture layer 286, separated by another dielectric layer.

The remainder of the optical cavity 274 includes a light guide 288 positioned proximate the reflective aperture layer 286, and a second reflective layer 290 on a side of the light guide 288 opposite the reflective aperture layer 286. A series of light redirectors 291 are formed on the rear surface of the light guide, proximate the second reflective layer. The light redirectors 291 may be either diffuse or specular reflectors. One or more light sources 292 inject light 294 into the light guide 288.

In an alternative implementation, an additional transparent substrate is positioned between the light guide 290 and the light modulation array 270. In this implementation, the reflective aperture layer 286 is formed on the additional transparent substrate instead of on the surface of the light guide 290.

In operation, application of a voltage to the electrode 282 of a cell (for example, cell 272*b* or 272*c*) causes the light absorbing oil 280 in the cell to collect in one portion of the cell 272. As a result, the light absorbing oil 280 no longer obstructs the passage of light through the aperture formed in the reflective aperture layer 286 (see, for example, cells 272*b* and 272*c*). Light escaping the backlight at the aperture is then able to escape through the cell and through a corresponding color filter (for example, red, green, or blue) in the set of color filters 276 to form a color pixel in an image. When the electrode 282 is grounded, the light absorbing oil 280 covers the aperture in the reflective aperture layer 286, absorbing any light 294 attempting to pass through it.

The area under which oil 280 collects when a voltage is applied to the cell 272 constitutes wasted space in relation to forming an image. This area cannot pass light through, whether a voltage is applied or not, and therefore, without the inclusion of the reflective portions of reflective apertures layer 286, would absorb light that otherwise could be used to contribute to the formation of an image. However, with the inclusion of the reflective aperture layer 286, this light, which otherwise would have been absorbed, is reflected back into the light guide 290 for future escape through a different aperture. The electrowetting-based light modulation array 270 is not the only example of a non-shutter-based MEMS modulator suitable for control by the control matrices described herein. Other forms of non-shutter-based MEMS modulators could likewise be controlled by various ones of the controller functions described herein without departing from the scope of this disclosure.

Figure 2C:
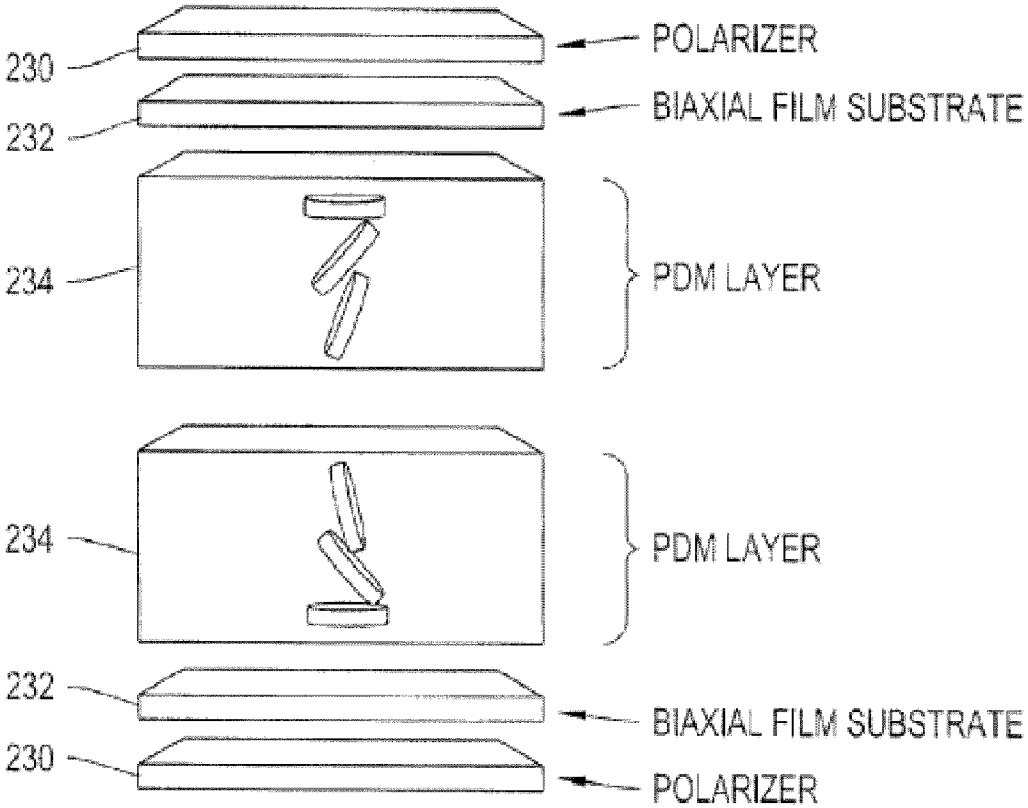
FIG. 2C shows an example of a field sequential liquid crystal display operating in optically compensated bend (OCB) mode.

In addition to MEMS displays, this disclosure also may make use of field sequential liquid crystal displays, including for example, liquid crystal displays operating in optically compensated bend (OCB) mode as shown in FIG. 2C. Coupling an OCB mode LCD display with the FSC method may allow for low power and high resolution displays. The LCD of FIG. 2C is composed of a circular polarizer 230, a biaxial retardation film 232, and a polymerized discotic material (PDM) 234. The biaxial retardation film 232 contains transparent surface electrodes with biaxial transmission properties. These surface electrodes act to align the liquid crystal molecules of the PDM layer in a particular direction when a voltage is applied across them.

Figure 3:
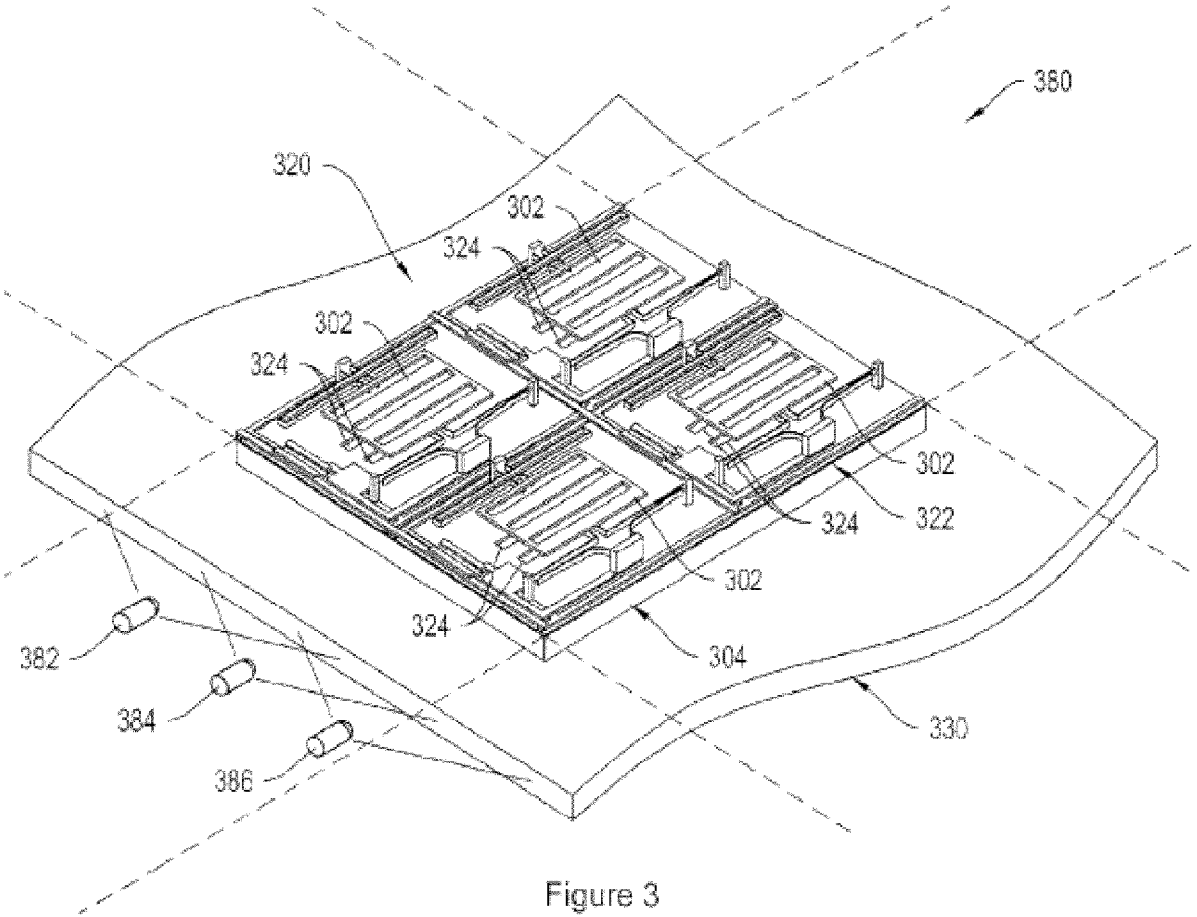
FIG. 3 shows an example perspective view of an array of shutter-based light modulators.

FIG. 3 shows a perspective view of an array 320 of shutter-based light modulators. FIG. 3 also illustrates the'array of light modulators 320 disposed on top of backlight 330. In one implementation, the backlight 330 is made of a transparent material, i.e., glass or plastic, and functions as a light guide for evenly distributing light from lamps 382, 384 and 386 throughout the display plane. When assembling the display 380 as a field sequential display, the lamps 382, 384 and 386 can be alternate color lamps, e.g., red, green and blue lamps respectively.

A number of different types of lamps 382-386 can be employed in the displays, including without limitation:

incandescent lamps, fluorescent lamps, lasers, or light emitting diodes (LEDs). Further, lamps 382-386 of the direct view display 380 can be combined into a single assembly containing multiple lamps. For instance a combination of red, green and blue LEDs can be combined with or substituted for a white LED in a small semiconductor chip, or assembled into a small multi-lamp package. Similarly each lamp can represent an assembly of 4-color LEDs, for instance a combination of red, yellow, green and blue LEDs or a combination of red, green, blue and white LEDs.

The shutter assemblies 302 function as light modulators. By use of electrical signals from the associated controller, the shutter assemblies 302 can be set into either an open or a closed state. The open shutters allow light from the lightguide 330 to pass through to the viewer, thereby forming a direct view image.

In some implementations, the light modulators are formed on the surface of substrate 304 that faces away from the light guide 330 and toward the viewer. In some other implementations, the substrate 304 can be reversed, such that the light modulators are formed on a surface that faces toward the light guide. In these implementations it is sometimes preferable to form an aperture layer, such as aperture layer 322, directly onto the top surface of the light guide 330. In some other implementations, it is useful to interpose a separate piece of glass or plastic between the light guide and the light modulators, such separate piece of glass or plastic containing an aperture layer, such as aperture layer 322, and associated aperture holes, such as aperture holes 324. It is preferable that the spacing between the plane of the shutter assemblies 302 and the aperture layer 322 be kept as close as possible, preferably less than 10 microns, in some cases as close as 1 micron.

In some displays, color pixels are generated by illuminating groups of light modulators corresponding to different colors, for example, red, green and blue. Each light modulator in the group has a corresponding filter to achieve the desired color. The filters, however, absorb a great deal of light, in some cases as much as 60% of the light passing through the filters, thereby limiting the efficiency and brightness of the display. In addition, the use of multiple light modulators per pixel decreases the amount of space on the display that can be used to contribute to a displayed image, further limiting the brightness and efficiency of such a display.

Figure 4:
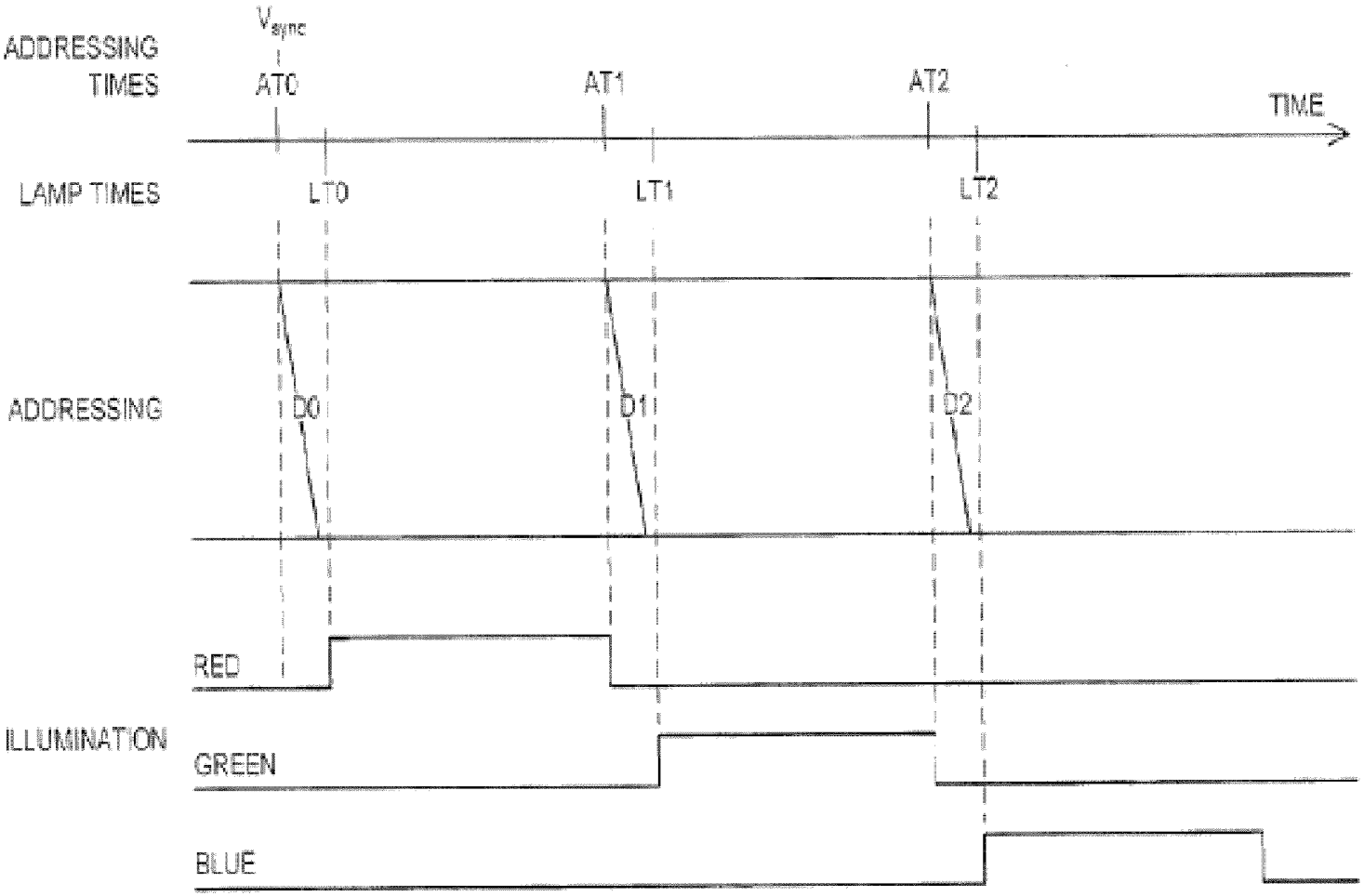
FIG. 4 shows an example timing diagram corresponding to a display process for displaying images using field sequential color (FSC).

FIG. 4 is a timing diagram 400 corresponding to a display process for displaying images using field sequential color (FSC), which can be implemented, for example, by a MEMS direct-view display described in FIG. 1B. The timing diagrams included herein, including the timing diagram 400 of FIGS. 4, 5, 6 and 7 conform to the following conventions. The top portions of the timing diagrams illustrate light modulator addressing events. The bottom portions illustrate lamp illumination events.

The addressing portions depict addressing events by diagonal lines spaced apart in time. Each diagonal line corresponds to a series of individual data loading events during which data is loaded into each row of an array of light modulators, one row at a time. Depending on the control matrix used to address and drive the modulators included in the display, each loading event may require a waiting period to allow the light modulators in a given row to actuate. In some implementations, all rows in the array of light modulators are addressed prior to actuation of any of the light modulators. Upon completion of loading data into the last row of the array of light modulators, all light modulators are actuated substantially simultaneously.

Lamp illumination events are illustrated by pulse trains corresponding to each color of lamp included in the display. Each pulse indicates that the lamp of the corresponding color is illuminated, thereby displaying the subframe image loaded into the array of light modulators in the immediately preceding addressing event.

The time at which the first addressing event in the display of a given image frame begins is labeled on each timing diagram as AT0. In most of the timing diagrams, this time falls shortly after the detection of a voltage pulse vsync, which precedes the beginning of each video frame received by a display. The times at which each subsequent addressing event takes place are labeled as AT1, AT2, . . . AT(n−1), where n is the number of subframe images used to display the image frame. In some of the timing diagrams, the diagonal lines are further labeled to indicate the data being loaded into the array of light modulators. For example, in the timing diagram of FIG. 4, D0 represents the first data loaded into the array of light modulators for a frame and D(n−1) represents the last data loaded into the array of light modulators for the frame. In the timing diagrams of FIGS. 5-7, the data loaded during each addressing event corresponds to a bitplane.

A bitplane is a coherent set of data identifying desired modulator states for modulators in multiple rows and multiple columns of an array of light modulators. Moreover, each bitplane corresponds to one of a series of subframe images derived according to a binary coding scheme. That is, each subframe image for a contributing color of an image frame is weighted according to a binary series 1, 2, 4, 8, 16, etc. The bitplane with the lowest weighting is referred to as the least significant bitplane and is labeled in the timing diagrams and referred to herein by the first letter of the corresponding contributing color followed by the number 0. For each next-most significant bitplane for the contributing colors, the number following the first letter of the contributing color increases by one. For example, for an image frame broken into 4 bitplanes per color, the least significant red bitplane is labeled and referred to as the R0 bitplane. The next most significant red bitplane is labeled and referred to as R1, and the most significant red bitplane is labeled and referred to as R3.

Lamp-related events are labeled as LT0, LT1, LT2 . . . LT(n−1). The lamp-related event times labeled in a timing diagram, depending on the timing diagram, either represent times at which a lamp is illuminated or times at which a lamp is extinguished. The meaning of the lamp times in a particular timing diagram can be determined by comparing their position in time relative to the pulse trains in the illumination portion of the particular timing diagram. Specifically referring back to the timing diagram 400 of FIG. 4, to display an image frame according to the timing diagram 400, a single subframe image is used to display each of three contributing colors of an image frame. First, data, D0, indicating modulator states desired for a red subframe image are loaded into an array of light modulators beginning at time AT0. After addressing is complete, the red lamp is illuminated at time LT0, thereby displaying the red subframe image. Data, D1, indicating modulator states corresponding to a green subframe image are loaded into the array of light modulators at time AT1. A green lamp is illuminated at time LT1. Finally, data, D2, indicating modulator states corresponding to a blue subframe image are loaded into the array of light modulators and a blue lamp is illuminated at times AT2 and LT2, respectively. The process then repeats for subsequent image frames to be displayed.

The number of luminance levels achievable by a display that forms images according to the timing diagram of FIG. 4 depends on how finely the state of each light modulator can be controlled. For example, if the light modulators are binary in nature, i.e., they can only be on or off, the display will be limited to generating 8 different colors. The number of luminance levels can be increased for such a display by providing light modulators than can be driven into additional intermediate states. In some implementations related to the field sequential technique of FIG. 4, MEMS-based or other light modulators can be provided which exhibit an analog response to applied voltage. The number of luminance levels achievable in such a display is limited only by the resolution of digital to analog converters which are supplied in conjunction with data voltage sources.

Alternatively, finer luminance level can be generated if the time period used to display each subframe image is split into multiple time periods, each having its own corresponding subframe image. For example, with binary light modulators, a display that forms two subframe images of equal length and light intensity per contributing color can generate 27 different colors instead of 8. Luminance level techniques that break each contributing color of an image frame into multiple subframe images are referred to, generally, as time division gray scale techniques.

Figure 5:
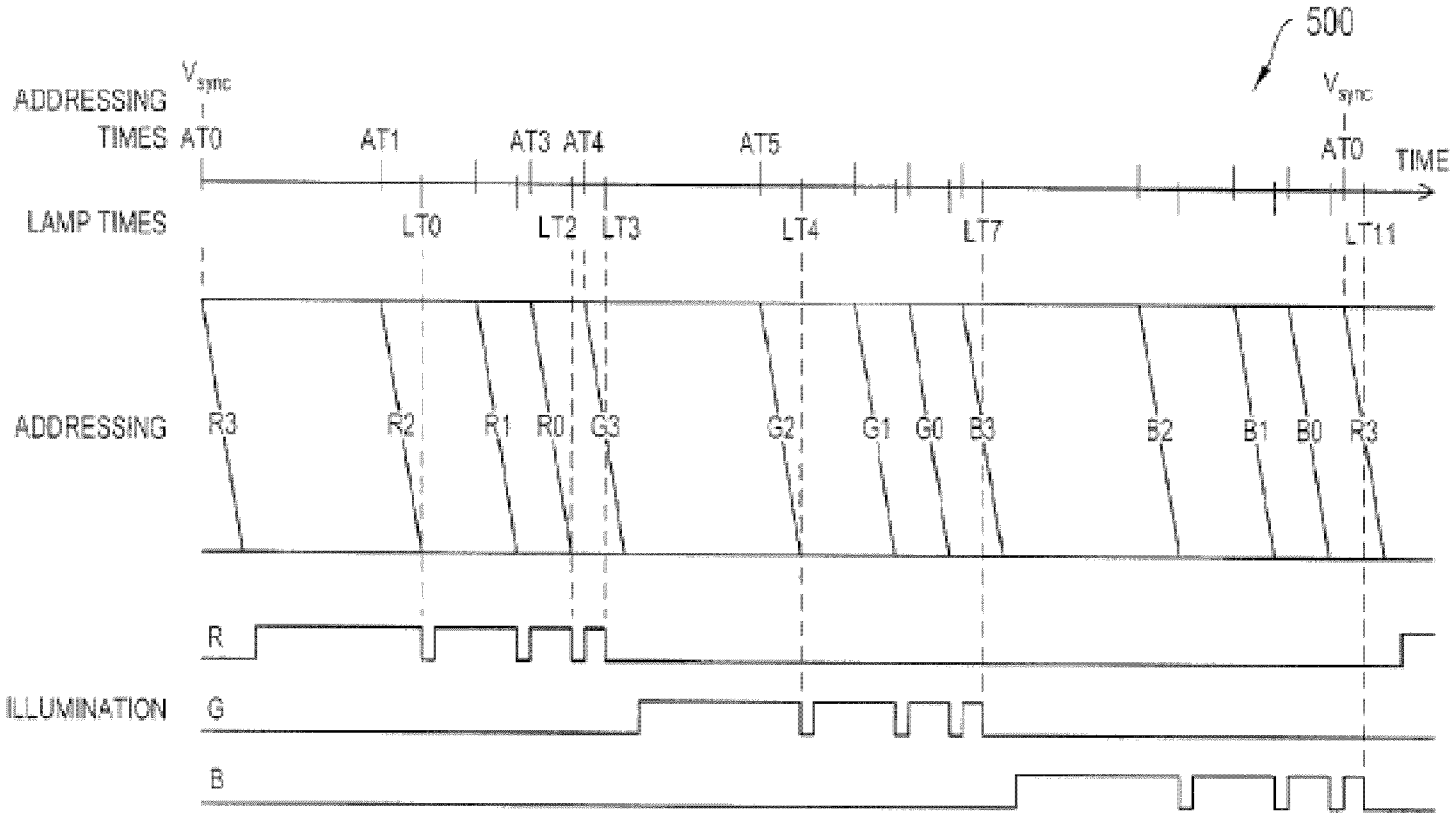
FIG. 5 shows an example timing sequence employed by the controller for the formation of an image using a series of subframe images in a binary time division gray scale process.

FIG. 5 illustrates an example of a timing sequence, referred to as a display process 500, employed by controller 134 for the formation of an image using a series of subframe images in a binary time division gray scale. The controller 134, used with the display process 500, is responsible for coordinating multiple operations in the timed sequence (time varies from left to right in FIG. 5). The controller 134 determines when data elements of a subframe data set are transferred out of the frame buffer and into the data drivers 132. The controller 134 also sends trigger signals to enable the scanning of rows in the array by means of scan drivers 130, thereby enabling the loading of data from the data from drivers 132 into the pixels of the array. The controller 134 also governs the operation of the lamp drivers 148 to enable the illumination of the lamps 140, 142 and 144 (the white lamp 146 is not employed in the display process 500). The controller 134 also sends trigger signals to the common drivers 138 which enable functions such as the global actuation of shutters substantially simultaneously in multiple rows and columns of the array.

The process of forming an image in the display process 500 includes, for each subframe image, first the loading of a subframe data set out of the frame buffer and into the array. A subframe data set includes information about the desired states of modulators (e.g., open or closed) in multiple rows and multiple columns of the array. For binary time division gray scale, a separate subframe data set is transmitted to the array for each bit level within each color in the binary coded word for gray scale. For the case of binary coding, a subframe data set is referred to as a bit plane. The display process 500 refers to the loading of 4 bitplane data sets in each of the three colors red, green, and blue. These data sets are labeled as R0-R3 for red, G0-G3 for green, and B0-B3 for blue. For economy of illustration, only 4 bit levels per color are illustrated in the display process 500, although it will be understood that alternate image forming sequences are possible that employ 6, 7, 8, or 10 bit levels per color.

The display process 500 refers to a series of addressing times AT0, AT1, AT2, etc. These times represent the beginning times or trigger times for the loading of particular bitplanes into the array. The first addressing time AT0 coincides with Vsync, which is a trigger signal commonly employed to denote the beginning of an image frame. The display process 500 also refers to a series of lamp illumination times LT0, LT1, LT2, etc., which are coordinated with the loading of the bitplanes. These lamp triggers indicate the times at which the illumination from one of the lamps 140, 142 and 144 is extinguished. The illumination pulse periods and amplitudes for each of the red, green, and blue lamps are illustrated along the bottom of FIG. 5, and labeled along separate lines by the letters "R", "G", and "B".

The loading of the first bitplane R3 commences at the trigger point AT0. The second bitplane to be loaded, R2, commences at the trigger point AT1. The loading of each bitplane requires a substantial amount of time. For instance the addressing sequence for bitplane R2 commences in this illustration at AT1 and ends at the point LT0. The addressing or data loading operation for each bitplane is illustrated as a diagonal line in timing diagram 500. The diagonal line represents a sequential operation in which individual rows of bitplane information are transferred out of the frame buffer, one at a time, into the data drivers 132 and from there into the array. The loading of data into each row or scan line requires anywhere from 1 microsecond to 100 microseconds. The complete transfer of multiple rows or the transfer of a complete bitplane of data into the array can take anywhere from 100 microseconds to 5 milliseconds, depending on the number of rows in the array.

In the display process 500, the process for loading image data to the array is separated in time from the process of moving or actuating the shutters 108. For this implementation, the modulator array includes data memory elements, such as a storage capacitor, for each pixel in the array and the process of data loading involves only the storing of data (i.e., on-off or open-close instructions) in the memory elements. The shutters 108 do not move until a global actuation signal is generated by one of the common drivers 138. The global actuation signal is not sent by the controller 134 until all of the data has been loaded to the array. At the designated time, all of the shutters designated for motion or change of state are caused to move substantially simultaneously by the global actuation signal. A small gap in time is indicated between the end of a bitplane loading sequence and the illumination of a corresponding lamp. This is the time required for global actuation of the shutters. The global actuation time is illustrated, for example, between the trigger points LT2 and AT4. It is preferable that all lamps be extinguished during the global actuation period so as not to confuse the image with illumination of shutters that are only partially closed or open. The amount of time required for global actuation of shutters, such as in shutter assemblies 320, can take, depending on the design and construction of the shutters in the array, anywhere from 10 microseconds to 500 microseconds.

For the example of the display process 500 the sequence controller is programmed to illuminate just one of the lamps after the loading of each bitplane, where such illumination is delayed after loading data of the last scan line in the array by an amount of time equal to the global actuation time. Note that loading of data corresponding to a subsequent bitplane can begin and proceed while the lamp remains on, since the loading of data into the memory elements of the array does not immediately affect the position of the shutters.

Each of the subframe images, e.g., those associated with bitplanes R3, R2, R1 and R0 is illuminated by a distinct illumination pulse from the red lamp 140, indicated in the "R" line at the bottom of FIG. 5. Similarly, each of the subframe images associated with bitplanes G3, G2, G1, and G0 is illuminated by a distinct illumination pulse from the green lamp 142, indicated by the "G" line at the bottom of FIG. 5. The illumination values (for this example the length of the illumination periods) used for each subframe image are related in magnitude by the binary series 8, 4, 2, 1, respectively. This binary weighting of the illumination values enables the expression or display of a gray scale value coded in binary words, where each bitplane contains the pixel on-off data corresponding to just one of the place values in the binary word. The commands that emanate from the sequence controller 160 ensure not only the coordination of the lamps with the loading of data but also the correct relative illumination period associated with each data bitplane.

A complete image frame is produced in the display process 500 between the two subsequent trigger signals Vsync. A complete image frame in the display process 500 includes the illumination of 4 bitplanes per color. For a 60 Hz frame rate the time between Vsync signals is 16.6 milliseconds. The time allocated for illumination of the most significant bitplanes (R3, G3 and B3) can be in this example approximately 2.4 milliseconds each. By proportion then, the illumination times for the next bitplanes R2, G2, and B2 would be 1.2 milliseconds. The least significant bitplane illumination periods, R0, G0, and B0, would be 300 microseconds each. If greater bit resolution were to be provided, or more bitplanes desired per color, the illumination periods corresponding to the least significant bitplanes would require even shorter periods, substantially less than 100 microseconds each.

It may be useful, in the development or programming of the sequence controller 160, to co-locate or store all of the critical sequencing parameters governing expression of luminance level in a sequence table, sometimes referred to as the sequence table store. An example of a table representing the stored critical sequence parameters is listed below as Table 1. The sequence table lists, for each of the subframes or "fields" a relative addressing time (e.g., AT0, at which the loading of a bitplane begins), the memory location of associated bitplanes to be found in buffer memory 159 (e.g., location M0, M1, etc.), an identification codes for one of the lamps (e.g., R, G, or B), and a lamp time (e.g., LT0, which in this example determines that time at which the lamp is turned off).

TABLE 1

Sequence Table 1

| | Field 1 | Field 2 | Field 3 | Field 4 | Field 5 | Field 6 | Field 7 | ... | Field n − 1 | Field n |
|---|---|---|---|---|---|---|---|---|---|---|
| addressing time | AT0 | AT1 | AT2 | AT3 | AT4 | AT5 | AT6 | ... | AT (n − 1) | ATn |
| memory location of sub-frame data set | M0 | M1 | M2 | M3 | M4 | M4 | M6 | ... | M (n − 1) | Mn |
| lamp ID | R | R | R | R | G | G | G | ... | B | B |
| lamp time | LT0 | LT1 | LT2 | LT3 | LT4 | LT5 | LT6 | ... | LT (n − 1) | LTn |

Also, it may be useful to co-locate the storage of parameters in the sequence table to facilitate an easy method for re-programming or altering the timing or sequence of events in a display process. For instance, it is possible to re-arrange the order of the color subframes so that most of the red subframes are immediately followed by a green subframe, and the green are immediately followed by a blue subframe. Such rearrangement or interspersing of the color subframes increase the nominal frequency at which the illumination is switched between lamp colors, which reduces the impact of CBU. By switching between a number of different schedule tables stored in memory, or by re-programming of schedule tables, it is also possible to switch between processes requiring either a lesser or greater number of bitplanes per color—for instance by allowing the illumination of 8 bitplanes per color within the time of a single image frame. It is also possible to easily re-program the timing sequence to allow the inclusion of subframes corresponding to a fourth color LED, such as the white lamp 146.

The display process 500 establishes gray scale or luminance level according to a coded word by associating each subframe image with a distinct illumination value based on the pulse width or illumination period in the lamps. Alternate methods are available for expressing illumination value. In one alternative, the illumination periods allocated for each of the subframe images are held constant and the amplitude or intensity of the illumination from the lamps is varied between subframe images according to the binary ratios 1, 2, 4, 8, etc. For this implementation, the format of the sequence table is changed to assign unique lamp intensities for each of the subframes instead of a unique timing signal. In some other implementations, both the variations of pulse duration and pulse amplitude from the lamps are employed and both specified in the sequence table to establish luminance level distinctions between subframe images.

Figure 6:
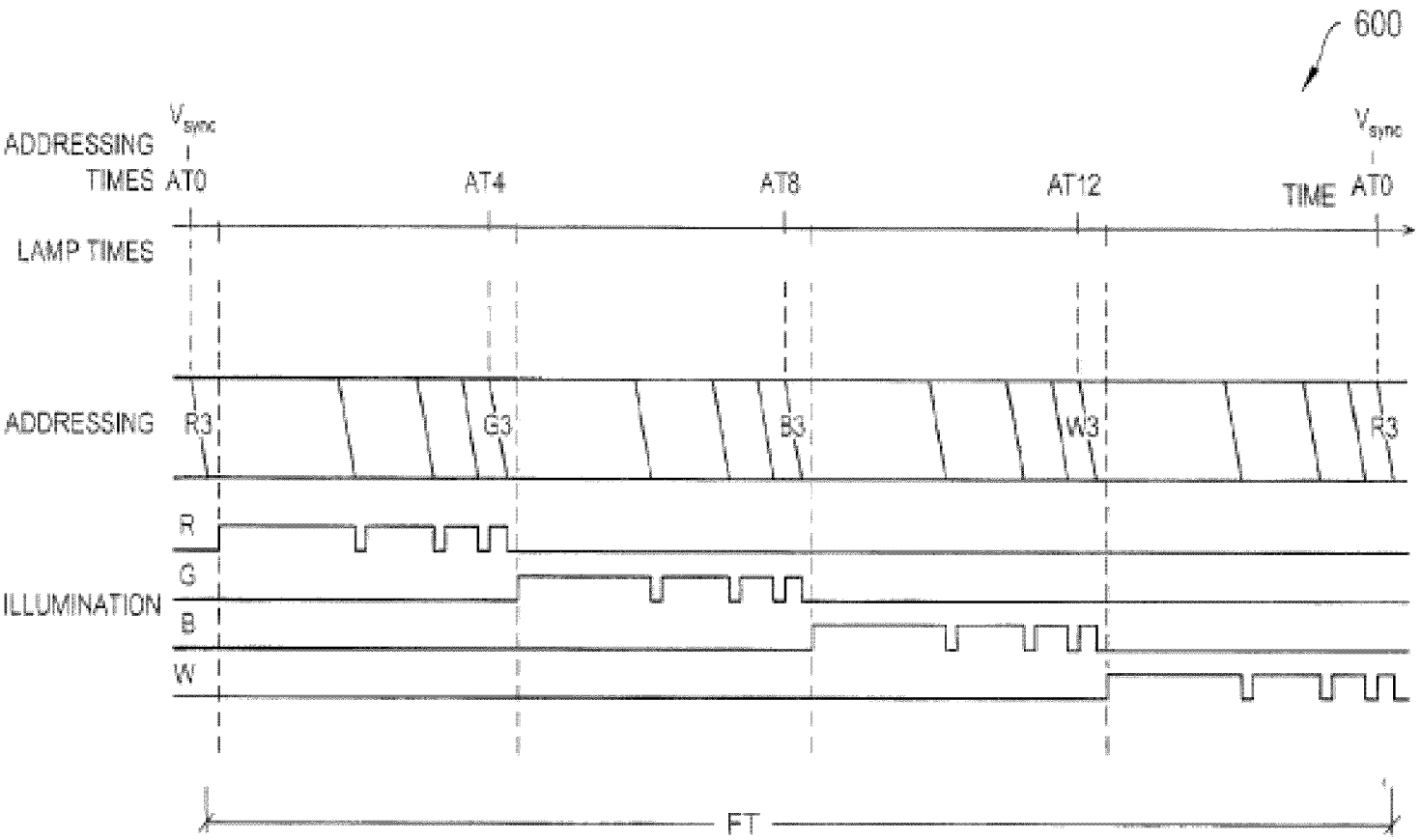
FIG. 6 shows an example timing diagram that corresponds to a coded-time division gray scale addressing process in which image frames are displayed by displaying four subframe images for each color component of the image frame.

FIG. 6 is a timing diagram 600 that utilizes the parameters listed in Table 2. The timing diagram 600 corresponds to a coded-time division gray scale addressing process in which image frames are displayed by displaying four subframe images for each contributing color of the image frame. Each subframe image displayed of a given color is displayed at the same intensity for half as long a time period as the prior subframe image, thereby implementing a binary weighting scheme for the subframe images. The timing diagram 600 includes subframe images corresponding to the color white, in addition to the colors red, green and blue, which are illuminated using a white lamp. The addition of a white lamp allows the display to display brighter images or operates its lamps at lower power levels while maintaining the same brightness level. As brightness and power consumption are not linearly related, the lower illumination level operating mode, while providing equivalent image brightness, consumes less energy. In addition, white lamps are often more efficient, i.e. they consume less power than lamps of other colors to achieve the same brightness.

More specifically, the display of an image frame in timing diagram 600 begins upon the detection of a vsync pulse. As indicated on the timing diagram and in the Table 2 schedule table, the bitplane R3, stored beginning at memory location M0, is loaded into the array of light modulators 150 in an addressing event that begins at time AT0. Once the controller 134 outputs the last row data of a bitplane to the array of light modulators 150, the controller 134 outputs a global actuation command. After waiting the actuation time, the controller 134 causes the red lamp to be illuminated. Since the actuation time is a constant for all subframe images, no corresponding time value needs to be stored in the schedule table store to determine this time. At time AT4, the controller 134 begins loading the first of the green bitplanes, G3, which, according to the schedule table, is stored beginning at memory location M4. At time AT8, the controller 134 begins loading the first of the blue bitplanes, B3, which, according to the schedule table, is stored beginning at memory location M8. At time AT12, the controller 134 begins loading the first of the white bitplanes, W3, which, according to the schedule table, is stored beginning at memory location M12. After completing the addressing corresponding to the first of the white bitplanes, W3, and after waiting the actuation time, the controller causes the white lamp to be illuminated for the first time.

Because all the bitplanes are to be illuminated for a period longer than the time it takes to load a bitplane into the array of light modulators 150, the controller 134 extinguishes the lamp illuminating a subframe image upon completion of an addressing event corresponding to the subsequent subframe image. For example, LT0 is set to occur at a time after AT0 which coincides with the completion of the loading of bitplane R2. LT1 is set to occur at a time after AT1 which coincides with the completion of the loading of bitplane R1.

The time period between vsync pulses in the timing diagram is indicated by the symbol FT, indicating a frame time. In some implementations, the addressing times AT0, AT1, etc. as well as the lamp times LT0, LT1, etc. are designed to accomplish 4 subframe images for each of the 4 colors within a frame time FT of 16.6 milliseconds, i.e., according to a frame rate of 60 Hz. In some other implementations, the time values stored in the schedule table store can be altered to accomplish 4 subframe images per color within a frame time FT of 33.3 milliseconds, i.e., according to a frame rate of 30 Hz. In some other implementations, frame rates as low as 24 Hz may be employed or frame rates in excess of 100 Hz may be employed.

TABLE 2

Schedule Table 2

| | Field 1 | Field 2 | Field 3 | Field 4 | Field 5 | Field 6 | Field 7 | . . . . . | Field n – 1 | Field n |
|---|---|---|---|---|---|---|---|---|---|---|
| addressing time | AT0 | AT1 | AT2 | AT3 | AT4 | AT5 | AT6 | . . . | AT (n – 1) | ATn |
| memory Location of sub-frame dataset | M0 | M1 | M2 | M3 | M4 | M4 | M6 | . . . | M9 (n – 1) | Mn |
| Lamp ID | R | R | R | R | G | G | G | . . . | W | W |

The use of white lamps can improve the efficiency of the display. The use of four distinct colors in the subframe images requires changes to the data processing in the input processing module 1003. Instead of deriving bitplanes for each of 3 different colors, a display process according to timing diagram 600 requires bitplanes to be stored corresponding to each of 4 different colors. The input processing module 1003 may therefore convert the incoming pixel data, encoded for colors in a 3-color space, into color coordinates appropriate to a 4-color space before converting the data structure into bitplanes.

In addition to the red, green, blue and white lamp combination, shown in the timing diagram 600, other lamp combinations are possible which expand the space or gamut of achievable colors. A useful 4-color lamp combination with expanded color gamut is red, blue, true green (about 520 nm) plus parrot green (about 550 nm). Another 5-color combination which expands the color gamut is red, green, blue, cyan, and yellow. A 5-color analogue to the YIQ NTSC color space can be established with the lamps white, orange, blue, purple and green. A 5-color analog to the well known YUV color space can be established with the lamps white, blue, yellow, red and cyan.

Other lamp combinations are possible. For instance, a useful 6-color space can be established with the lamp colors red, green, blue, cyan, magenta and yellow. A 6-color space also can be established with the colors white, cyan, magenta, yellow, orange and green. A large number of other 4-color and 5-color combinations can be derived from amongst the colors already listed above. Further combinations of 6, 7, 8 or 9 lamps with different colors can be produced from the colors listed above. Additional colors may be employed using lamps with spectra which lie in between the colors listed above.

Figure 7:
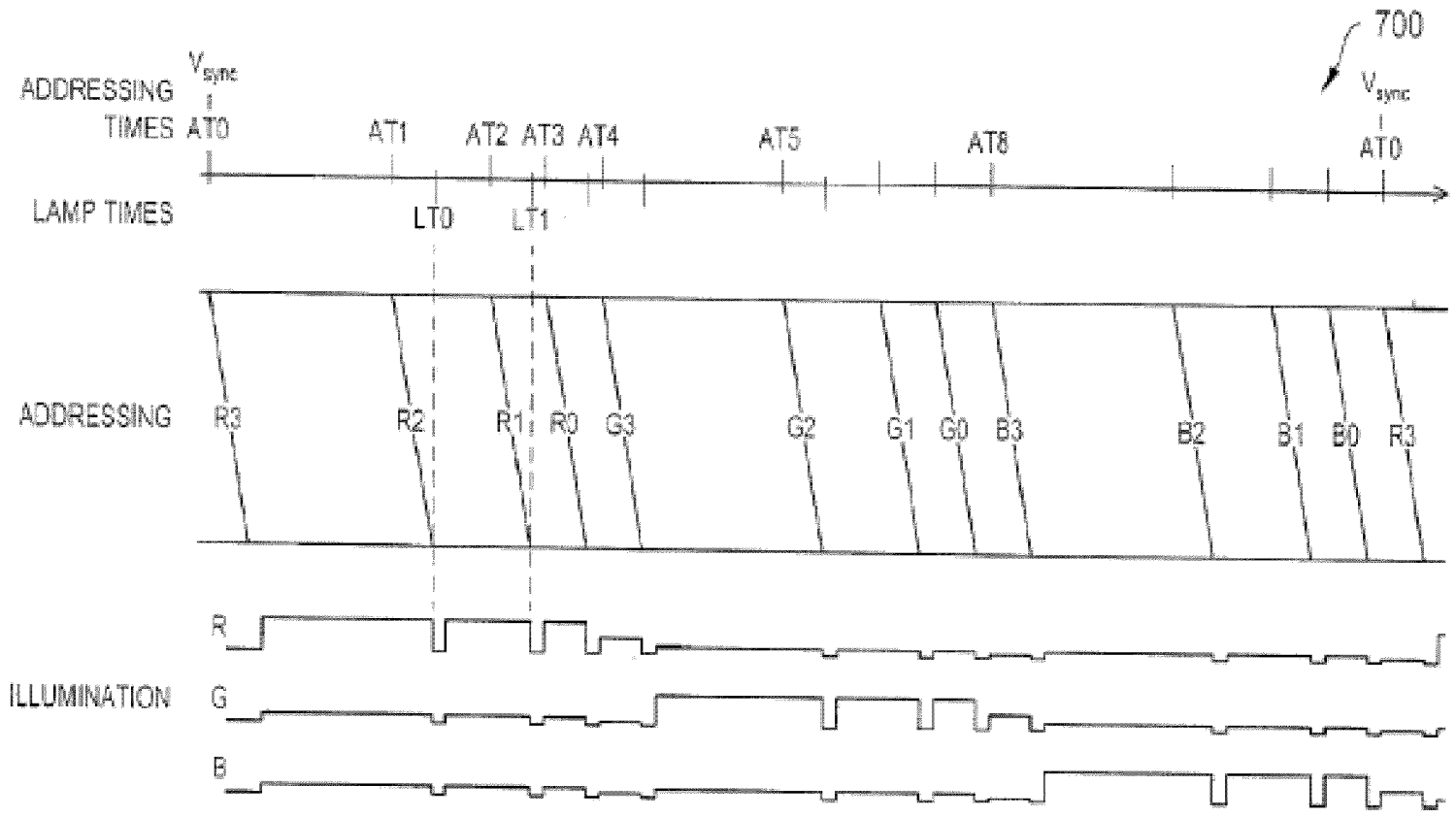
FIG. 7 shows an example timing diagram that corresponds to a hybrid coded-time division and intensity gray scale display process in which lamps of different colors may be illuminated simultaneously.

FIG. 7 is a timing diagram 700 that utilizes the parameters listed in the schedule table of Table 3. The timing diagram 700 corresponds to a hybrid coded-time division and intensity gray scale display process in which lamps of different colors may be illuminated simultaneously. Though each subframe image is illuminated by lamps of all colors, subframe images for a specific color are illuminated predominantly by the lamp of that color. For example, during illumination periods for red subframe images, the red lamp is illuminated at a higher intensity than the green lamp and the blue lamp. As brightness and power consumption are not linearly related, using multiple lamps each at a lower illumination level operating mode may require less power than achieving that same brightness using one lamp at a higher illumination level.

The subframe images corresponding to the least significant bitplanes are each illuminated for the same length of time as the prior subframe image, but at half the intensity. As such, the subframe images corresponding to the least significant bitplanes are illuminated for a period of time equal to or longer than that required to load a bitplane into the array.

TABLE 3

Schedule Table 3

| | Field 1 | Field 2 | Field 3 | Field 4 | Field 5 | Field 6 | Field 7 | . . . . . | Field n – 1 | Field n |
|---|---|---|---|---|---|---|---|---|---|---|
| data time | AT0 | AT1 | AT2 | AT3 | AT4 | AT5 | AT6 | . . . | AT (n – 1) | ATn |
| memory location of subframe date set | M0 | M1 | M2 | M3 | M4 | M4 | M6 | . . . | M9 (n – 1) | Mn |
| red average intensity | RI0 | RI1 | RI2 | RI3 | RI4 | RI5 | RI6 | . . . | RI (n – 1) | Rn |
| green average intensity | GI0 | GI1 | GI2 | GI3 | GI4 | GI5 | GI6 | . . . | GI (n – 1) | Gn |
| blue average intensity | BI0 | BI1 | BI2 | BI3 | BI4 | BI5 | BI6 | . . . | BI (n – 1) | Bn |

More specifically, the display of an image frame in the timing diagram 700 begins upon the detection of a vsync pulse. As indicated on the timing diagram 700 and in the Table 3 schedule table, the bitplane R3, stored beginning at memory location M0, is loaded into the array of light modulators 150 in an addressing event that begins at time AT0. Once the controller 134 outputs the last row data of a bitplane to the array of light modulators 150, the controller 134 outputs a global actuation command. After waiting the actuation time, the controller causes the red, green and blue lamps to be illuminated at the intensity levels indicated by the Table 3 schedule, namely RI0, GI0 and BI0, respectively. Since the actuation time is a constant for all subframe images, no corresponding time value needs to be stored in the schedule table store to determine this time. At time AT1, the controller 134 begins loading the subsequent bitplane R2, which, according to the schedule table, is stored beginning at memory location M1, into the array of light modulators 150. The subframe image corresponding to bitplane R2, and later the one corresponding to bitplane R1, are each illuminated at the same set of intensity levels as for bitplane R1, as indicated by the Table 3 schedule. In comparison, the subframe image corresponding to the least significant bitplane R0, stored beginning at memory location M3, is illuminated at half the intensity level for each lamp. That is, intensity levels RI3, GI3 and BI3 are equal to half that of intensity levels RI0, GI0 and BI0, respectively. The timing diagram 700 continues at time AT4, at which time bitplanes in which the green intensity predominates are displayed. Then, at time ATB, the controller 134 begins loading bitplanes in which the blue intensity dominates.

Because all the bitplanes are to be illuminated for a period longer than the time it takes to load a bitplane into the array of light modulators 150, the controller 134 extinguishes the lamp illuminating a subframe image upon completion of an addressing event corresponding to the subsequent subframe image. For example, LT0 is set to occur at a time after AT0 which coincides with the completion of the loading of bitplane R2. LT1 is set to occur at a time after AT1 which coincides with the completion of the loading of bitplane R1.

The mixing of color lamps within subframe images in the timing diagram 700 can lead to improvements in power efficiency in the display. Color mixing can be particularly useful when images do not include highly saturated colors.

As described above, certain display apparatus have been implemented that use an image formation process that generates a combination of separate color subframe images, which the mind blends together to form a single image frame. One example of this type of image formation process is referred to as RGBW image formation, the name deriving from the fact that images are generated using a combination of red (R), green (G), blue (B) and white (W) sub-images. Each of the colors used to form a subframe image is referred to herein, generically, as a "contributing" color. Certain contributing colors also may be referred to either as "component" or "composite" colors. A composite color is a color that is substantially the same as the combination of at least two component colors. As commonly known, red, green, and blue, when combined, are perceived by viewers of a display as white. Thus, for an RGBW image formation process, as used herein, white would be referred to as a "composite color" having "component colors" of red, green, and blue. In other implementations, the display apparatus can use a different set of 4 contributing colors, e.g., cyan, yellow, magenta, and white, where white is a composite color, and cyan, yellow, and magenta are component colors. In some implementations, the display apparatus can use 5 or more contributing colors, e.g., red, green, blue, cyan, and yellow. In some of such implementations, yellow is a considered a composite color having component colors of red and green. In others of such implementations, cyan is considered a composite color having component colors of yellow, green, and blue.

Various methods described herein can be employed to reduce image artifacts that occur in various display devices. Examples of image artifacts include DFC, CBU and flicker. In some implementations, display devices can reduce image artifacts by implementing one or more of a variety of image formation techniques, such as those described herein. It may be appreciated that the described techniques can be utilized as described, or can be utilized with any combination of techniques. Furthermore, the techniques, variants, or combinations thereof can be used for image formation for other display devices, such as for field sequential displays devices, like plasma displays, LCD, OLED, electrophoretic, and field emission displays. In operation, each of the techniques or combination of techniques, implemented by the display device can be incorporated into an imaging mode.

An imaging mode corresponds to at least one subframe sequence and at least one corresponding set of weighting schemes and luminance level lookup tables (LLLTs). A weighting scheme defines the number of distinct subframe images used to generate the range of luminance levels the display will be able to display, along with the weight of each such subframe image. A LLLT associated with the weighting scheme stores combinations of pixel states used to obtain each of the luminance levels in the range of possible luminance levels given the number and weights of each subframe. A pixel state is identified by a discrete value, e.g., 1 for "on"

and 0 for "off." A given combination of pixel states represented by their corresponding values is referred to as a "code word." A subframe sequence defines the actual order in which all subframe images for all colors will be output on the display device or apparatus. For example, a subframe sequence would indicate that the most significant subframe of red should be followed by the most significant subframe of blue, followed by the most significant subframe of green, etc. If the display apparatus were to implement "bit splitting" as described herein, this would also be defined in the subframe sequence. The subframe sequence, combined with the timing and illumination information used to implement the weights of each subframe image, constitutes the output sequence described above.

As examples, using this parlance, the first two rows of the LLLT 1050 of FIG. 10, described further below, are an example of a weighting scheme. The second two rows of the LLLT 1050 are illustrated entries in the LLLT 1050 associated with the color scheme. For example, the LLLT 1050 stores the code word "01111111" in relation to a luminance value 127. In contrast, the first two rows of table 1702 of FIG. 17A, described further below, sets forth a subframe sequence.

Weighting schemes used in various implementations disclosed herein may be binary or non-binary. With binary weighting schemes, the weight associated with a given pixel state is twice that of the pixel state with the next lowest weight. As such, each luminance value can only be represented by a single combination of pixel states. For example, an 8-state binary weighting scheme (represented by a series of 8-bits) provides a single combination of pixel states (which may be displayed according to different ordering schemes depending on the subframe sequence employed) for each of 256 different luminance values ranging from 0 to 255.

In a non-binary weighting scheme, weights are not strictly assigned according to a base-2 progression (i.e., not 1, 2, 4, 8, 16, etc.). For example, the weights can be 1, 2, 4, 6, 10, etc. as further described in, e.g., FIG. 12B. In this scheme it is possible that multiple pixel states can be assigned the same weight. Alternatively, or in addition, pixel states may be assigned some weight less than twice the next lower weighted pixel state. This requires the use of additional pixel states, but provides the advantage of enabling the display apparatus to generate the same luminance level of a contributing color using multiple different combinations of pixel states. This property is referred to as "degeneracy." For example, a coding scheme using 12-bit code words formed of 12-bits each having two states (e.g., 1 and 0) can be used to represent a maximum of 4096 distinct states. If used to only represent 256 separate luminance levels, the remaining states (i.e., 4096−256=3840) can be used to form degenerate code words, or alternative combination of pixel states, for those same 256 luminance levels. While each of the 3840 degenerate code words may be available, the luminance level lookup table may only store one or a select few combinations of pixel states for each luminance level. These combinations of pixel states are identified during the design process as yielding improved image quality and reduced likelihood of resulting in image artifacts.

Figure 8:
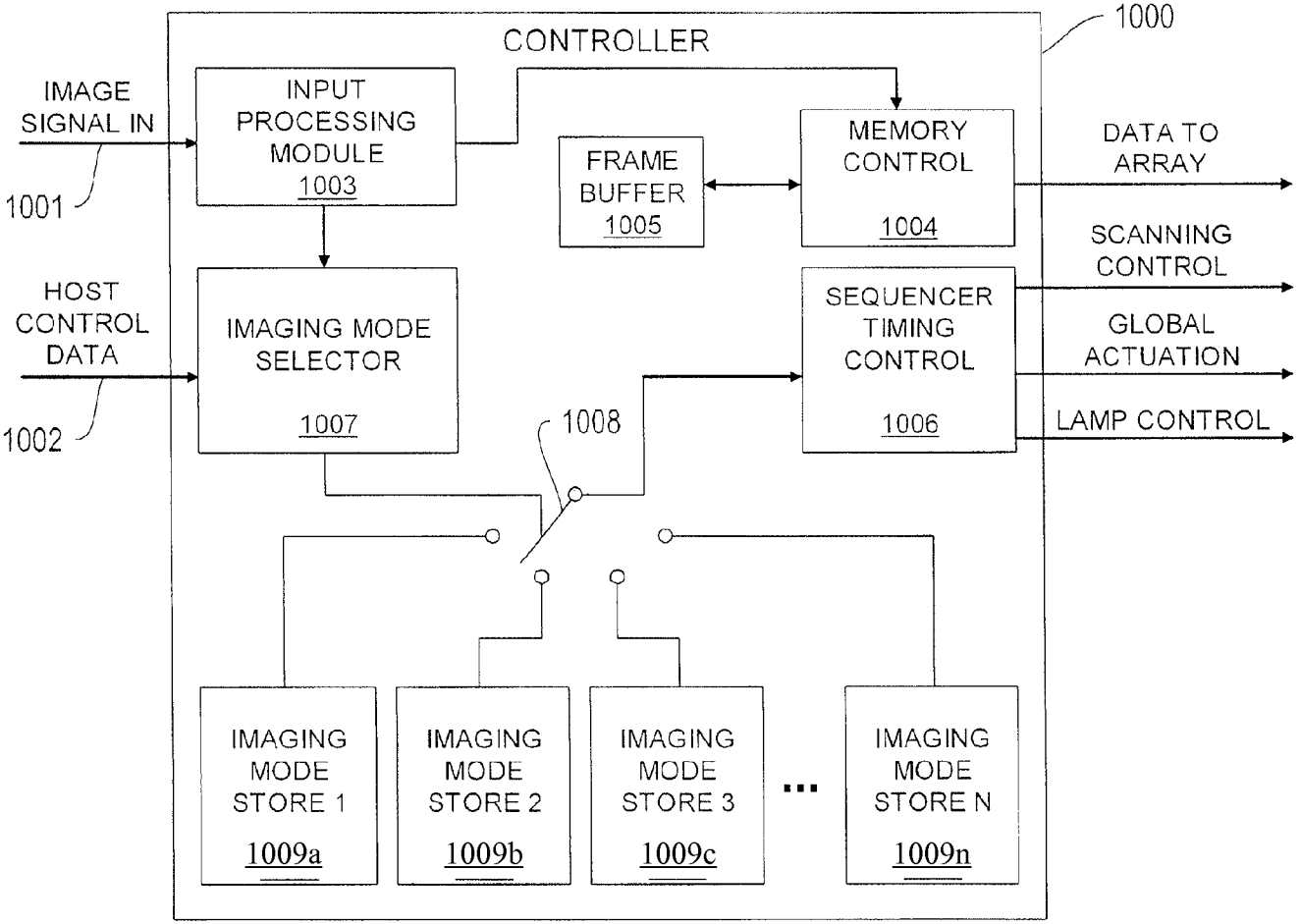
FIG. 8 shows an example block diagram of a controller for use in a display.

FIG. 8 shows a block diagram of a controller, such as the controller 134 of FIG. 1B, for use in a display. The controller 1000 includes an input processing module 1003, a memory control module 1004, a frame buffer 1005, a timing control module 1006, an imaging mode selector 1007, and a plurality of unique imaging mode stores 1009*a-n*, each containing data sufficient to implement a respective imaging mode. The controller 1000 also can include a switch 1008 responsive to the imaging mode selector 1007 for switching between the various imaging modes. In some implementations, the components may be provided as distinct chips or circuits which are connected together by means of circuit boards, cables, or other electrical interconnects. In some other implementations, several of these components can be designed together into a single semiconductor chip such that their boundaries are nearly indistinguishable except by function.

The controller 1000 receives an image signal 1001 from an external source such as a host device incorporating the controller, as well as host control data 1002 from the host device 120 and outputs both data and control signals for controlling light modulators and lamps of the display 128 into which it is incorporated.

The input processing module 1003 receives the image signal 1001 and processes the data encoded therein into a format suitable for displaying via the array of light modulators 100. The input processing module 1003 takes the data encoding each image frame and converts it into a series of subframe data sets. The input processing module 1003 may convert the image signal into bit planes, non-coded subframe data sets, ternary coded subframe data sets, or other form of coded subframe data sets. In addition, in some implementations, described further below in relation to FIG. 10, content providers and/or the host device encode additional information into the image signal 1001 to affect the selection of an imaging mode by the controller 1000. Such additional data is sometimes referred to as metadata. In such implementations, the input processing module 1003 identifies, extracts, and forwards this additional information to the pre-set imaging mode selector 1007 for processing.

The input processing module 1003 also outputs the subframe data sets to the memory control module 1004. The memory control module 1004 then stores the subframe data sets in the frame buffer 1005. The frame buffer 1005 is preferably a random access memory, although other types of serial memory can be used without departing from the scope of this disclosure. The memory control module 1004, in one implementation, stores the subframe data set in a predetermined memory location based on the color and significance in a coding scheme of the subframe data set. In some other implementations, the memory control module stores the subframe data set in a dynamically determined memory location and stores that location in a lookup table for later identification.

The memory control module 1004 is also responsible for, upon instruction from the timing control module 1006, retrieving sub-image data sets from the frame buffer 1005 and outputting them to the data drivers 132. The data drivers load the data output by the memory control module into the light modulators of the array of light modulators 100. The memory control module 1004 outputs the data in the sub-image data sets one row at a time. In some implementations, the frame buffer 1005 includes two buffers, whose roles alternate. While the memory control module stores newly generated subframes corresponding to a new image frame in one buffer, it extracts subframes corresponding to the previously received image frame from the other buffer for output to the array of light modulators. Both buffer memories can reside within the same circuit, distinguished only by address.

Data defining the operation of the display module for each of the imaging modes are stored in the imaging mode stores 1009*a-n*. Specifically, in one implementation, this data takes the form of a scheduling table, such as the scheduling tables described above in relation to FIGS. 5, 6 and 7 along with addresses of a set of LLLTs for use with the imaging mode. As described above, a scheduling table includes distinct timing values dictating the times at which data is loaded into the light modulators as well as when lamps are both illuminated and extinguished. In certain implementations, the imaging mode stores 1009*a-n* store voltage and/or current magnitude values to control the brightness of the lamps. Collectively, the information stored in each of the imaging mode stores provide a choice between distinct imaging algorithms, for instance between display modes which differ in the properties of frame rate, lamp brightness, color temperature of the white point, bit levels used in the image, gamma correction, resolution, color gamut, achievable luminance level precision, or in the saturation of displayed colors. The storage of multiple mode tables, therefore, provides for flexibility in the method of displaying images, a flexibility which is especially advantageous when it provides a method for reducing image artifacts when displaying an image on a display. In some implementations, the data defining the operation of the display module for each of the imaging modes are integrated into a baseband, media or applications processor, for example, by a corresponding IC company or by a consumer electronics original equipment manufacturer (OEM).

In another implementation, not depicted in FIG. 8, memory (e.g., random access memory) can be used to generically store the level of each color for any given image. This image data can be collected for a predetermined amount of image frames or elapsed time. The histogram provides a compact summarization of the distribution of data in an image. This information can be used by the imaging mode selector 1007 to select an imaging mode. This allows the controller 1000 to select future imaging modes based on information derived from previous images.

Figure 9:
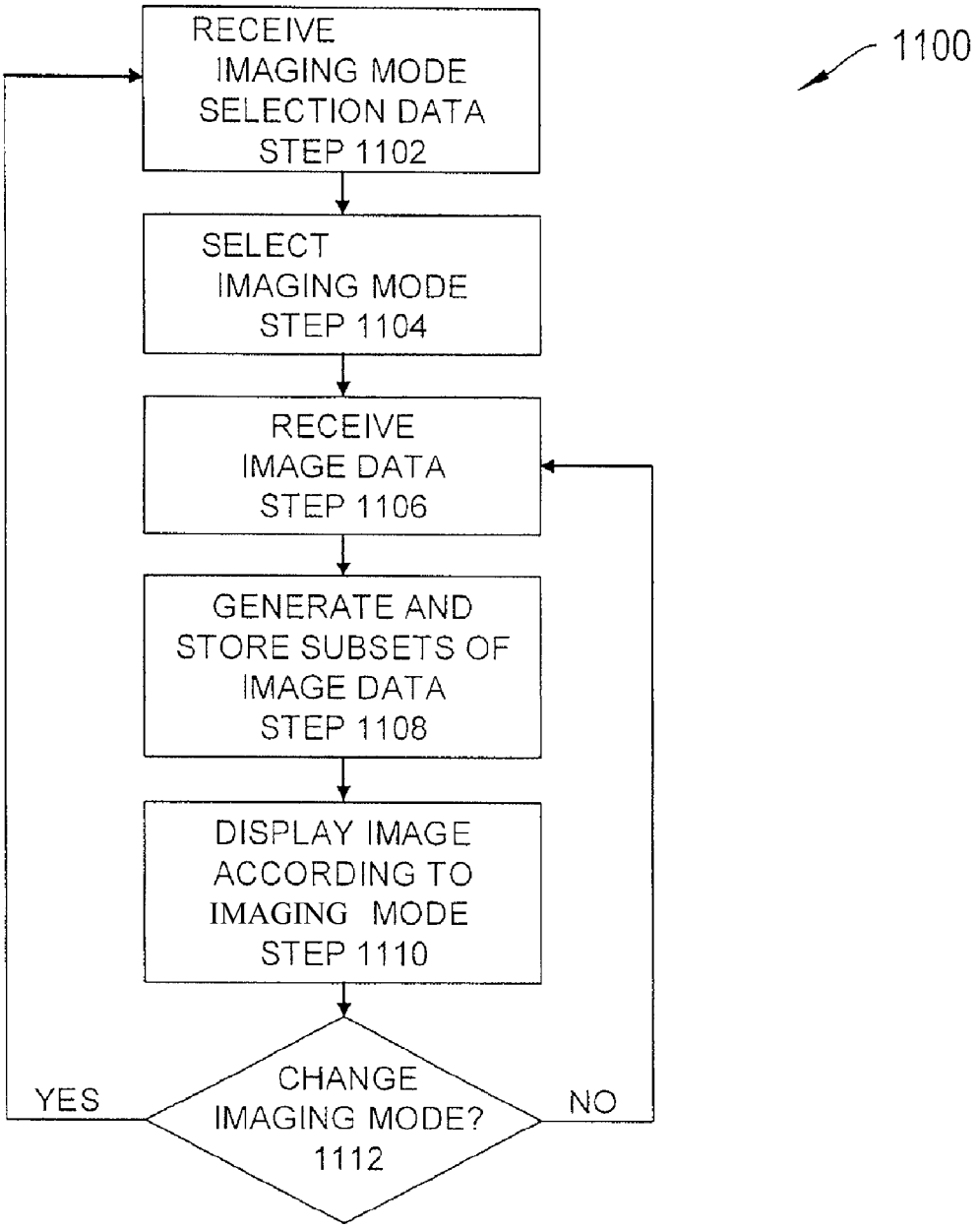
FIG. 9 shows an example flow chart of a process by which the controller can display images according to one or more imaging modes.

FIG. 9 shows a flow chart of a process of displaying images 1100 suitable for use by a display including a controller such as the controller of FIG. 8. The display process 1100 begins with the receipt of mode selection data (block 1102). Mode selection data is used by the imaging mode selector 1007 to select an operating mode (block 1104). Image frame data is then received (block 1106). In alternate implementations, image data is received prior to image mode selection (block 1104), and image data is used in the selection process. Subsets of image data are then generated and stored (block 1108), which are then displayed according to the selected imaging mode (block 1110). The process is repeated based on based on a decision (block 1112).

As described above, the display process 1100 begins with the receipt of mode selection data, which can be used to select an operating mode. For example, in various implementations, mode selection data includes, without limitation, one or more of the following types of data: image color composition data, a content type identifier, a host mode operation identifier, environmental sensor output data, user input data, host instruction data, and power supply level data. Image color composition data can provide an indication of the contribution of each of the contributing colors forming the colors of the image. A content type identifier identifies the type of image being displayed. Illustrative image types include text, still images, video, web pages, computer animation, or an identifier of a software application generating the image. The host mode operation identifier identifies a mode of operation of the host. Such modes will vary based on the type of host device in which the controller is incorporated. For example, for a cell phone, illustrative operating modes include a telephone mode, a camera mode, a standby mode, a texting mode, a web browsing mode, and a video mode. Environmental sensor data includes signals from sensors such as photodetectors and thermal sensors. For example, the environmental data indicates levels of ambient light and temperature. User input data includes instructions provided by the user of the host device. This data may be programmed into software or controlled with hardware (e.g., a switch or dial). Host instruction data may include a plurality of instructions from the host device, such as a "shut down" or "turn on" signal. Power supply level data is communicated by the host processor and indicates the amount of power remaining in the host's power source.

In another implementation, the image data received by the input processing module 1003 includes header data encoded according to a codec for selection of display modes. The encoded data may contain multiple data fields including user defined input, type of content, type of image, or an identifier indicating the specific display mode to be used. The data in the header also may contain information pertaining to when a certain imaging mode can be used. For example, the header data indicates that the imaging mode be updated on a frame-by-frame basis, after a certain number of frames, or the imaging mode can continue indefinitely until information indicates otherwise.

Based on these data inputs, the imaging mode selector 1007 determines the appropriate imaging mode (block 1104) based on some or all of the mode selection data received at block 1102. For example, a selection is made between the imaging modes stored in the imaging mode stores 1009*a-n*. When the selection amongst imaging modes is made by the imaging mode selector, it can be made in response to the type of image to be displayed. For example, video or still images require finer levels of luminance level contrast versus an image which needs only a limited number of contrast levels, such as a text image. In some implementations, the selection amongst imaging modes is made by the imaging mode selector to improve image quality. As such, an imaging mode that mitigates image artifacts, like DFC, CBU and flicker may be selected. Another factor that can influence the selection of an imaging mode is the colors being displayed in the image. It has been determined that an observer can more readily perceive image artifacts associated with some perceptually brighter colors, such as green, relative to other colors, such as red or blue. DFC therefore is more readily perceived and in greater need of mitigation when displaying closely spaced luminance levels of green than closely spaced luminance levels of red or blue. Another factor that can influence the selection of an imaging mode is the ambient lighting of the device. For example, a user might prefer a particular brightness for the display when viewed indoors or in an office environment versus outdoors where the display must compete in an environment of bright sunlight. Brighter displays are more likely to be viewable in an ambient of direct sunlight, but brighter displays consume greater amounts of power. The mode selector, when selecting imaging modes on the basis of ambient light, can make that decision in response to signals it receives through an incorporated photodetector. Another factor that can influence the selection of an imaging mode is the level of stored energy in a battery powering the device in which the display is incorporated. As batteries near the end of their storage capacity it may be preferable to switch to an imaging mode which consumes less power to extend the life of the battery. In one instance, the input processing module monitors and analyzes the content of the incoming image to look for an indicator of the type of content. For example, the input processing module can determine if the image signal contains text, video, still image, or web content. Based on the indicator, the imaging mode selector 1007 can determine the appropriate imaging mode (block 1104).

In implementations where the image data received by the input processing module 1003 includes header data encoded according to a codec for selection of display modes, the image processing module 1003 can recognize the encoded data and pass the information on to the imaging mode selector 1007. The mode selector then chooses the appropriate imaging mode based on one or multiple sets of data in the codec (block 1104).

The selection block 1104 can be accomplished by means of logic circuitry, or in some implementations, by a mechanical relay, which changes the reference within the timing control module 1006 to one of the imaging mode stores 1009*a-n*. Alternately, the selection block 1104 can be accomplished by the receipt of an address code which indicates the location of one of the imaging mode stores 1009*a-n*. The timing control module 1006 then utilizes the selection address, as received through the switch control 1008, to indicate the correct location in memory for the imaging mode.

At block 1108, the input processing module 1003 derives a plurality of subframe data sets based on the selected imaging mode and stores the subframe data sets in the frame buffer 1005. A subframe data set contains values that correspond to pixel states for all pixels for a specific bit # of a particular contributing color. To generate a subframe data set, the input processing module 1003 identifies an input pixel color for each pixel of the display apparatus corresponding to a given image frame. For each pixel, the input processing module 1003 determines the luminance level for each contributing color. Based on the luminance level for each contributing color, the input processing module 1003 can identify a code word corresponding to the luminance level in the weighting scheme. The code words are then processed one bit at a time to populate the subframe sets.

After a complete image frame has been received and generated subframe data sets have been stored in the frame buffer 1005, the method 1100 proceeds to block 1110. At block 1110, the sequence timing control module 1006 processes the instructions contained within the imaging mode store and sends signals to the drivers according to the ordering parameters and timing values that have been pre-programmed within the imaging mode. In some implementations, the number of subframes generated depends on the selected mode. As described above, the imaging modes correspond to at least one subframe sequence and corresponding weighting schemes. In this way, the imaging mode may identify a subframe sequence having a particular number of subframes for one or more of the contributing colors, and further identify a weighting scheme from which to select a particular code word corresponding to each of the contributing colors. After storage of the subframe data sets, the timing control module 1006 proceeds to display each of the subframe data sets, at block 1110, in their proper order as defined by the subframe sequence and according to timing and intensity values stored in the imaging mode store.

The process 1100 can be repeated based on decision block 1112. In some implementations, the controller executes process 1100 for an image frame received from the host processor. When the process reaches decision block 1112, instructions from the host processor indicate that the imaging mode does not need to be changed. The process 1100 then continues receiving subsequent image data at block 1106. In some other implementations, when the process reaches decision block 1112, instructions from the host processor indicate that the imaging mode does need to change to a different mode. The process 1100 then begins again at block 1102 by receiving new imaging mode selection data. The sequence of receiving image data at block 1106 through the display of the subframe data sets at block 1110 can be repeated many times, where each image frame to be displayed is governed by the same selected imaging mode table. This process can continue until directions to change the imaging mode are received at decision block 1112. In an alternative implementation, decision block 1112 may be executed only on a periodic basis, e.g., every 10 frames, 30 frames, 60 frames, or 90 frames. Or in another implementation, the process begins again at block 1102 only after the receipt of an interrupt signal emanating from one or the other of the input processing module 1003 or the imaging mode selector 1007. An interrupt signal may be generated, for instance, whenever the host device makes a change between applications or after a substantial change in the output of one of the environmental sensors.

It is instructive to consider some example techniques of how the method 1100 can reduce image artifacts by choosing the appropriate imaging mode in response to the image data collected at block 1204. These example techniques are generally referred to as image artifact reduction techniques. The following example techniques are further classified into techniques for reducing DFC, techniques for reducing CBU, techniques for reducing flicker artifacts, and techniques for reducing multiple artifact types.

In general, the ability to use different code word representations for a given luminance level of a contributing color provides for more flexibility in reducing image artifacts. In a binary weighting scheme, where each luminance level can only be represented using a single code word representation assuming a fixed subframe sequence. Therefore, the controller only can use one combination of pixel states to represent that luminance level. In a non-binary weighting scheme, where each luminance level can be represented using multiple, different (or "degenerate") combination of pixel states, the controller has the flexibility to select a particular combination of pixel states that reduces the perception of image artifacts, without causing image degradation.

As set forth above, a display apparatus can implement a non-binary weighting scheme to generate various luminance levels. The value of doing so is best understood in comparison to the use of binary weighting schemes. Digital displays often employ binary weighting schemes in generating multiple subframe images to produce a given image frame, where each subframe image for a contributing color of an image frame is weighted according to a binary series 1, 2, 4, 8, 16, etc. However, binary weighting can contribute to DFC, resulting from situations whereby a small change in luminance values of a contributing color creates a large change in the temporal distribution of outputted light. In turn, the motion of either the eye or the area of interest causes a significant change in temporal distribution of light on the eye.

Binary weighting schemes use the minimum number of bits required to represent all the luminance levels between two fixed luminance levels. For example, for 256 levels, 8 binary weighted bits can be utilized. In such a weighting scheme, each luminance level between 0 to 255, resulting in a total of 256 luminance levels, has only one code word representation (i.e., there is no degeneracy).

FIG. 10 shows a luminance level lookup table 1050 (LLLT 1050) suitable for use in implementing an 8-bit binary weighting scheme. The first two rows of the LLLT 1050 define the weighting scheme associated with the LLLT 1050. The remaining two rows are merely example entries in the table corresponding to two particular luminance levels, i.e., luminance levels 127 and 128.

As mentioned above, the first two rows of the LLLT 1050 define its associated weighting scheme. Based on the first row, labeled "Bit #," it is evident that the weighting scheme is based on the use of separate subframe images, each represented by a bit, to generate a given luminance level. The second row, labeled "Weight," identifies the weight associated with each of the 8 subframes. As can be seen based on the weight values, the weight of each subframe is twice that of the prior weight, going from bit 0 to bit 7. Thus, the weighting scheme is a binary weighted weighting scheme.

The entries of the LLLT 1050 identify values (1 or 0) for the state (on or off) of a pixel in each of the 8 subframe images used to generate a given luminance level. The corresponding luminance level is identified in the right-most column. The string of values makes up the code word for the luminance level. For illustrative purposes, the LLLT 1050 includes entries for luminance levels 127 and 128. As a result of binary weighting, the temporal distribution of the outputted light between luminance levels, such as luminance levels 127 and 128 changes dramatically. As can be seen in the LLLT 1050, light corresponding to luminance level 127 occurs at the end of the code word, whereas the light corresponding to luminance level 128 occurs in the beginning of the code word. This distribution can lead to undesirable levels of DFC.

Thus, in some techniques provided herein, non-binary weighting schemes are used to reduce DFC. In these techniques, the number of bits forming a code word for a given range of luminance values is higher than the number of bits used for forming code words using a binary weighting scheme including the same range of luminance values.

FIG. 11 shows a luminance level lookup table 1140 (LLLT 1140) suitable for use in implementing a 12-bit non-binary weighting scheme. Similar to LLLT 1050 shown in FIG. 10, the first two rows of the LLLT 1140 define the weighting scheme associated with the LLLT 1140. The remaining ten rows are example entries in the table corresponding to two particular luminance levels, i.e., luminance levels 127 and 128.

The LLLT 1140 corresponds to a 12-bit non-binary weighting scheme that uses a total of 12 bits to represent 256 luminance levels (i.e., luminance levels 0 to 255). In this non-binary weighting scheme, the weighting scheme includes a monotonically increasing sequence of weights.

As set forth above, the LLLT 1140 includes multiple illustrative code word entries for two luminance levels. Although each of the luminance levels can be represented by 30 unique code words using the weighting scheme corresponding to LLLT 1140, only 5 out of 30 unique code words are shown for each luminance level. Since DFC is associated with substantial changes in the temporal output of the light distribution, DFC can be reduced by selecting particular code words from the full set of possible code words that reduce changes in the temporal light distribution between adjacent luminance levels. Thus, in some implementations, an LLLT may include one or a select number of code words for a given luminance level, even though many more may be available using the weighting scheme.

LLLT 1140 includes code words for two particularly salient luminance values, 127 and 128. In an 8-bit binary weighting scheme, these luminance values result in the most divergent distribution of light of any two neighboring luminance values and thus, when shown adjacent to one another, are most likely to result in detectable DFC. The benefit of a non-binary weighting scheme becomes evident when comparing entries 1142 and 1144 of the LLLT 1140. Instead of a highly divergent distribution of light, use of these two entries to generate luminance levels of 127 and 128 results in hardly any divergence. Specifically, the difference is in the least significant bits.

In alternative 12-bit non-binary weighting schemes likewise used to generate 256 luminance levels, a set of monotonically increasing weights is followed by a set of equal weights. For example, another representation that uses a total of 12 bits and can be used to represent 256 luminance levels is provided by the weighting scheme [32, 32, 32, 32, 32, 32, 32, 16, 8, 4, 2, 1]. In still other implementations, a weighting scheme is formed of a first weighting scheme and a second weighting scheme, where the first weighting scheme is a binary weighting scheme and the second weighting scheme is a non-binary weighting scheme. For example, the first three or four weights of the weighting scheme are part of a binary weighting scheme (e.g., 1, 2, 4, 8). The next set of bits may have a set of monotonically increasing non-binary weights where the $N_{th}$ weight ($w_N$) in the weighting scheme is equal to $w_{N-1}+w_{N-3}$, or the $N_{th}$ weight ($w_N$) in the weighting scheme is equal to $w_{N-1}+w_{N-4}$, and where the total of all the weights in the weighting scheme equals the number of luminance levels.

To determine which code words are included in an LLLT, various combinations of code words can be evaluated to analyze their potential contribution to DFC. Specifically, a DFC metric function D(x) can be defined based on the difference in light distribution between two code words:

$$D(x)=\Sigma_{i=1}^{N}[Abs(\{M_i(x)\}-\{M_i(x-1)\})*W_i] \quad \text{Eqn. 1}$$

where x is a given luminance level, $M_i(x)$ is the bit value for that luminance level, $W_i$ is weight for bit i, N is the total number of bits of the color in the code word, and Abs is the absolute value function.

To reduce DFC, the function D(x) can be minimized for every luminance level x by using various representations $M_i$. LLLTs are then formed from the identified code word representations. Generally, an optimization procedure can then include finding the best code words that allows for minimization of D(x) for each of the luminance levels.

FIG. 12A shows an example portion of a display 1200 depicting a second technique for DFC, namely concurrently generating the same luminance level at two pixels using different code words and thus different combinations of pixel states. Specifically, the display portion includes a 7×7 grid of pixels. The luminance levels for 20 of the pixels are indicated as A1, A2, B1 or B2. As used in the Figure, the luminance level A1 is the same as the luminance level A2 (128), though generated using a different combination of pixel states. Similarly luminance level B1 is the same as the luminance level B2 (127), though generated using a different combination of pixel states.

FIG. 12B shows an example LLLT 1220 suitable for use in generating the display 1200 of FIG. 12A according to an illustrative implementation. Specifically, LLLT 1220 includes two rows that define a color weighting sequence and illustrative entries for luminance levels 127 and 128. LLLT 1220 includes two entries for each luminance level. In various implementations of this technique, a display controller selects the specific entry from the LLLT used to generate a luminance level for a particular pixel according to various processes. For example, to generate display 1200, the choice between using A1 versus A2 to generate a luminance level of 128 was made at random. Alternatively, the display controller can select entries from two separate lookup tables that contain different entries for each luminance level, or select entries according to a predetermined sequence, for example.

FIG. 12C shows an example portion of a display 1230, indicating, for each pixel, the identification of a particular LLLT to be used for selecting code words for the pixel. FIG. 12C depicts yet another alternative for spatially varying the code words used to generate pixel values on a display apparatus. In the display 1230, two LLLTs labeled $b^A$ and $b^B$, are alternatively assigned to the pixels in a "checkerboard" fashion, i.e., alternating every row and column. In some implementations, the controller applying the two LLLTs reverses the checkerboard assignment every frame.

FIG. 12D shows two example charts graphically depicting the contents of two LLLTs, suitable for use as LLLTs $b^A$ and $b^B$ described in relation to FIG. 12C. The vertical axis of each chart corresponds to a luminance level. The horizontal axis reflects individual code word positions arranged as they would appear in a particular subframe sequence with binary weights, from left to right of [9, 8, 6, 8, 1, 2, 4, 8, 8, 9]. The white portions represent non-zero values for a bit, and the dark portions represent zero values for a bit. In total, each chart represents re-ordered code words for 64 luminance levels, ranging from 0 to 63.

As can be seen, even though the two charts cover the same range of luminance levels using the same weighting scheme, the charts look quite different. These differences indicate that the LLLTs represented take advantage of the degeneracy made available by the non-binary weighting scheme depicted above. In general, it can be seen that in the chart corresponding to LLLT $b^A$, the illumination tends to be focused on the latter end of the sequence, whereas the illumination is focused at the beginning end of the sequence in the chart corresponding to LLLT $b^B$.

Other weighting sequences that may be useful for the alternating LLLTs used in FIG. 12C include [12, 8, 6, 5, 4, 2, 1, 8, 8, 9], [15, 8, 4, 2, 1, 8, 8, 4, 9, 4], [4, 12, 2, 13, 1, 4, 2, 4, 8, 13], [17, 4, 1, 8, 4, 4, 7, 4, 2, 12], [12, 4, 4, 8, 1, 2, 4, 8, 7, 13], and [13, 4, 4, 4, 2, 1, 4, 4, 10, 17]. For FIGS. 12C and 12D it is assumed that the same weighting sequence is used for both the $b^A$ and $b^B$ LLLTs. In other implementations, different weighting sequences are used for the $b^A$ and $b^B$ LLLTs. In some implementations, the weighting sequences may be the same for each of the contributing colors.

FIG. 12E shows an example portion of a display 1250 depicting a technique, particularly suited for higher pixel-per-inch (PPI) display apparatus, for reducing DFC by concurrently generating the same luminance level at four pixels using different combinations of pixel states. Specifically, FIG. 12E shows a portion of the display 13250, indicating, for each pixel, the identification of one of four different LLLTs, $b^A$, $b^B$. $b^C$, and $b^D$, to be used for selecting code words for the pixel. In the display 1250, the four LLLTS are assigned to pixels in a 2×2 block. The block is then repeated across and down the display. In alternative implementations, the assignment of the different LLLTS to pixels within a block can vary from block-to-block. For example, the LLLT assignments may be rotated or flipped with respect to the assignment used in a previous block. In some implementations, the controller may alternate between two mirror image LLLT assignments in a checkerboard-like fashion.

Figure 12F:
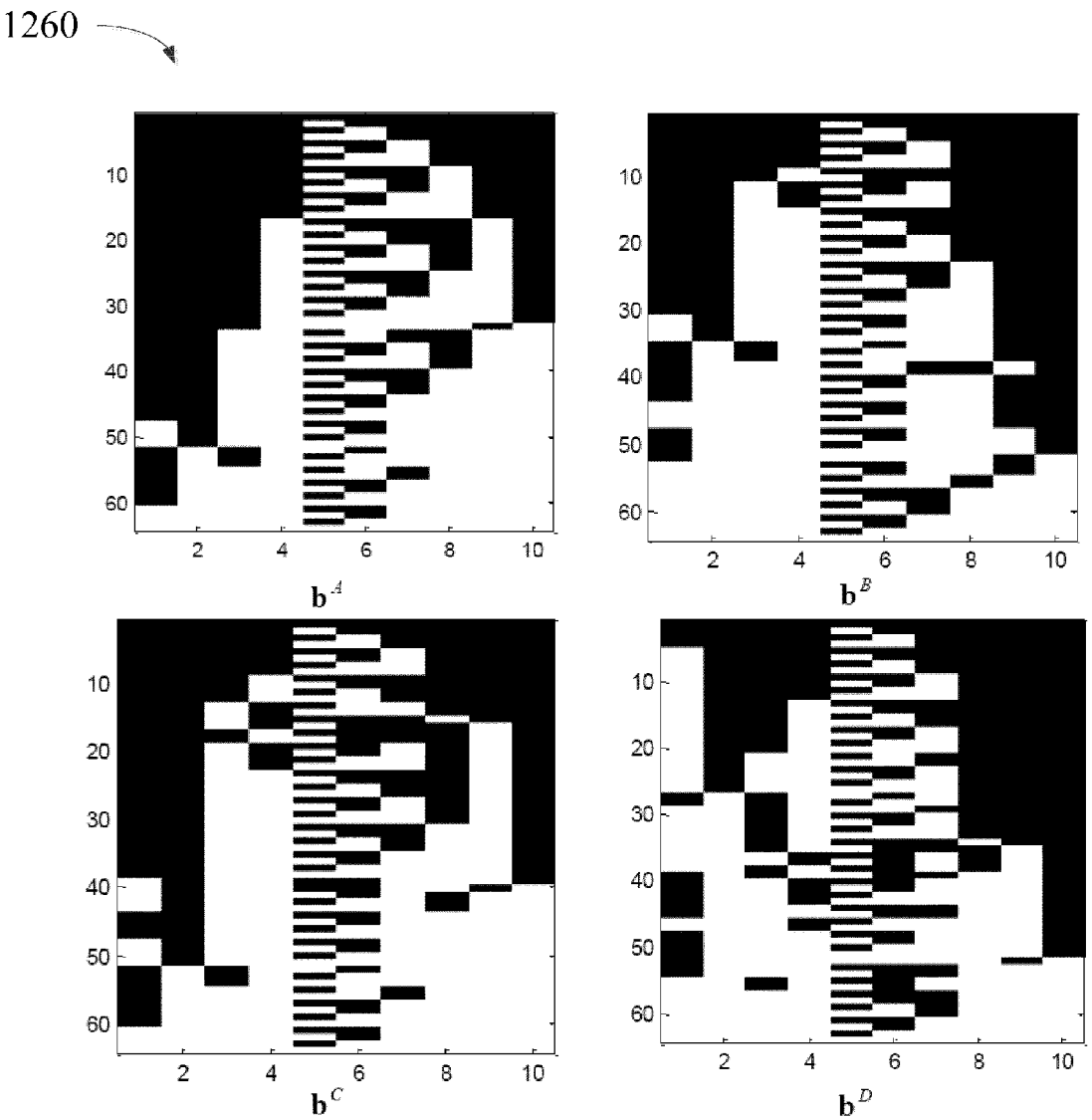
FIG. 12F shows four example charts graphically depicting the contents of four LLLTs described in relation to FIG. 12E.

FIG. 12F, similar to FIG. 12D, graphically depicts the various code words included in each of the LLLTs assigned to the pixels in the display 1250. As in FIG. 12D, each chart depicted in FIG. 12F depicts the same range of luminance levels using the same number and same weighting of pixel states. In this case, the pixel states are weighted according to the following sequence: [4, 13, 6, 8, 1, 2, 4, 8, 8, 9]. Due to the degeneracy of the weighting scheme used, each chart appears meaningfully different from the others.

The principle depicted in FIGS. 12C-F can be extended to the use of additional LLLTs and LLLT-to-pixel assignment schemes. For example, LLLTs may be assigned to pixels in any suitable fashion, including randomly, in various repeating blocks of N×M pixels (where N and/or M is greater than 1) each having a different LLLT assigned to it, by row, or by column. Larger pixel regions where each pixel within the region is associated with a different LLLT may be useful for higher PPI display having a greater density of pixels per unit area, such as greater than about 200 PPI.

FIG. 13 illustrates two tables 1302 and 1304 setting forth subframe sequences suitable for employing a third process for spatially varying the code words used to generate pixel values on a display apparatus. In this process, instead of alternating between LLLTs, a controller implementing this technique alternates between two subframe sequences. Referring to tables 1302 and 1304, both tables include three rows. The first two rows together identify the subframe sequences according to which subframe data sets are output for display in generating a single image frame. The first row identifies the color of the subframe data set to be output, and the second row specifies which of the subframe data sets associated with the color is to be output. The final row indicates the weight associated with the output of that particular subframe.

In tables 1302 and 1304, the subframe sequences include 36 subframes corresponding to three contributing colors, red, green, and blue. The difference between the subframe sequences corresponding to tables 1302 and 1304, as indicated by the arrows, is an interchanging of two bit locations having the same weight (e.g., the location in the code word of the second bit-split green bit #4 is interchanged with the location in the code word of green bit #3). As the color and weight of the interchanged bits are the same, the subframe sequences can be alternated on a pixel-by-pixel basis within a given image frame.

In some techniques, DFC can be mitigated by temporally varying the code words used to generate pixel values on a display apparatus. Some such techniques use the ability to employ multiple code word representations to represent the same luminance level.

Figure 14:
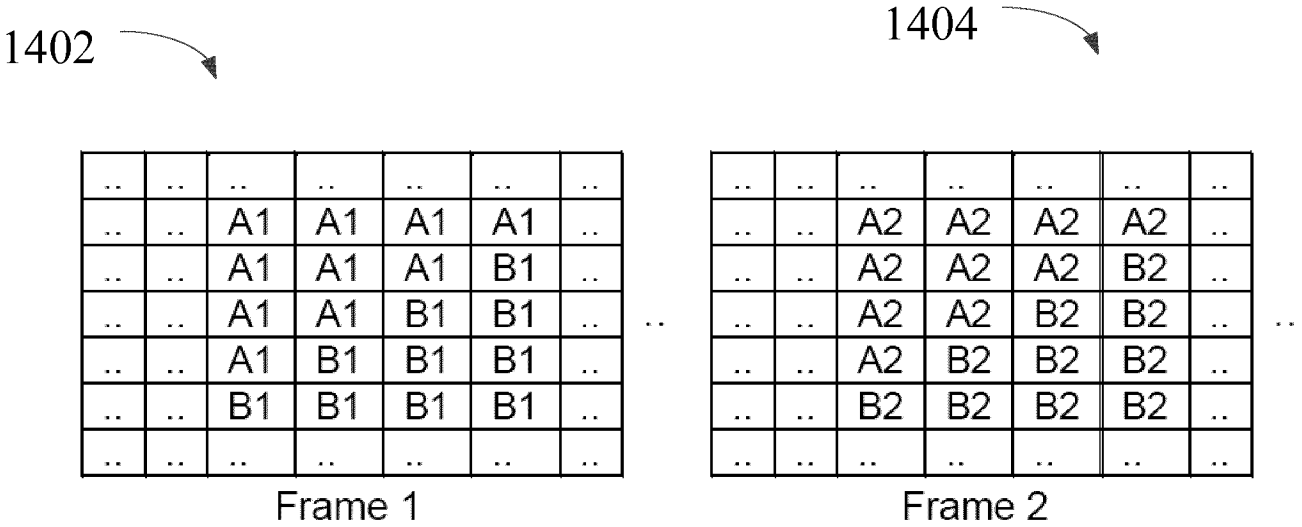
FIG. 14 shows an example pictorial representation of subsequent frames of the same display pixels in a localized area of a display.

FIG. 14 demonstrates this technique via a pictorial representation of subsequent frames 1402 and 1404 of the same display pixels in a localized area of a display. That is, the luminance values of pixels are the same in both image frames, either A or B. However, those luminance levels are generated via different combinations of pixel states represented by different code words. Code word entries A1, A2 (for luminance level 128) and B1, B2 (for luminance level 127) can correspond, for example, to the entries shown in table 1200 of FIG. 12A. During Frame 1, code words corresponding to entries A1 and B1 are used to display an image frame, and during subsequent Frame 2, code words corresponding to entries A2 and B2 are used. This technique can be expanded to multiple frames as well utilizing more than 2 code words for the same luminance level in consecutive frames. Similarly, the concept can be extended to the use of different LLLTs for each frame, regardless of the values of any given pixel. Although the example shown in FIG. 14 illustrates the technique for temporally varying patterns of code words using non-binary weighting schemes, the technique can be implemented using binary weighting schemes, with bit splitting. In some implementations, the temporal variation of the pixel states can be achieved by varying the placement of bits within a subframe sequence, for example as illustrated in FIG. 13. In some implementations, the pixel states are varied both temporally and spatially, for example by combining the techniques for spatially varying the code words used to generate pixel values on a display apparatus, as described with respect to FIGS. 12A and 12E and temporally varying the code words used to generate pixel values on a display apparatus, as described with respect to FIG. 14. In some implementations, two separate LLLTs may be used for temporally varying the code words similar to the technique described with respect to FIG. 12C. However, in this implementation, the two LLLTs are assigned to the same pixel but are used in an alternating pattern, image frame-to-image frame. In this way, odd numbered frames can be displayed using the first LLLT and even numbered frames can be displayed using even numbered frames. In some implementations, the pattern is reversed for spatially adjacent pixels or blocks of pixels, resulting in the LLLTs being applied in a checkerboard-like fashion that reverses each image frame.

In some techniques, a subframe sequence can have different bit arrangements for different colors. This can enable the customization of DFC reduction for different colors, as DFC reduction can be less for blue as compared to red and further less as compared to green. The following examples can illustrate the implementation of such a technique.

FIG. 15A shows an example table 1502 setting forth a subframe sequence having different bit arrangements for different contributing colors suitable for use by the display apparatus 128 of FIG. 1B. This technique can be useful for enabling perceptually equal DFC reduction based on color. For example, for illustrative purposes, FIG. 15A shows such an implementation where the grouping of most significant bits with the bit having the largest weighting arranged with consecutively lower weighted bits on both sides is different for different colors. As shown in FIG. 15A, green has its 4 most significant bits grouped together (e.g., bits #4-7), red has 3 of its most significant bits grouped together (e.g., bits #5-7), and blue has 2 of its most significant bits grouped together (e.g., bits #6 and 7).

As described above, in some techniques, a subframe sequence can have different bit arrangements for different colors. One way in which a subframe sequence can employ different bit arrangements includes the use of bit-splitting. Bit-splitting provides additional flexibility in the design of a subframe sequence, and can be used for the reduction of DFC. Bit-splitting is a technique whereby bits of a contributing color having significant weights can be split and displayed multiple times (each time for a fraction of the bit's full duration or intensity) in a given image frame.

FIG. 15B shows an example table 1504 setting forth a subframe sequence in which different numbers of bits are split for different contributing colors suitable for use by the display apparatus 128 of FIG. 1B. In the table 1504, the subframe sequence includes 10 subframes corresponding to blue, where bits #6 and 7 have been split (resulting in 10 transitions per 8 bit color), 11 subframes corresponding to red, where bits #5, 6 and 7 have been split (resulting in 11 transitions per 8 bit color), and 12 subframes corresponding to green, where bits #4, 5, 6, and 7 have been split (resulting in 12 transitions per 8 bit color). Such an arrangement is only one of many possible arrangements. Another example can have 9 transitions for blue, 12 transitions for red, and 15 transitions for green. As illustrated in the table 1504, the subframe sequence corresponds to a binary weighting scheme. This technique of bit-splitting is also applicable to non-binary weighting schemes.

Another way in which a subframe sequence can employ different bit arrangements includes using different bit depth for different contributing colors. As used herein, bit depth refers to the number of separately valued bits used to represent a luminance level of a contributing color. As described herein, the use of a non-binary weighting scheme, as described with respect to FIG. 11, allows for the use of more bits to represent a particular luminance level. In particular, 12 bits were used to represent a luminance level 127, whereas in a binary weighting scheme, only 8 bits are used (as described with respect to FIG. 10). Providing degeneracy allows a display apparatus to select a particular combination of pixel states that reduces the perception of image artifacts, without causing image degradation. In this way, using different weighting schemes (e.g., 12-bit non binary weighting scheme vs. 8-bit binary weighting scheme) for different colors is an example of how different colors can use more bits. In some implementations then, using different bit depths for two or more contributing colors allows for the use of more bits for perceptually brighter colors (e.g., green). This allows for more DFC mitigation bit arrangements for the colors using greater bit depths.

FIG. 15C shows an example table 1508 setting forth a subframe sequence in which different numbers of bits are used for different contributing colors. In the table 1508, the subframe sequence includes 12 subframes corresponding to 12 unique bits for green (using a non-binary weighting), 11 subframes corresponding to 11 unique bits for red, and 9 subframes corresponding to 9 unique bits for blue to enable sufficient DFC mitigation via available degenerate code words. The unique bits are illustrated by their unique bit numbers, which is in contrast to bits that are split, in which the bit numbers are the same for subframes corresponding to a bit that is split. For example, in the table 1504, which illustrates the concept of bit-splitting, red bit #7 is split into two subframes 1505A and 1505B both having the same corresponding bit numbers, and blue bit #7 is split into two subframes 1506A and 1506B, which also have the same corresponding bit numbers.

One technique for mitigating DFC employs the use of dithering. One implementation of this technique uses a dithering algorithm, such as the Floyd-Steinberg error diffusion algorithm, or variants thereof, for spatially dithering an image. Certain luminance levels are known to elicit a particularly severe DFC response. This technique identifies such luminance levels in a given image frame, and replaces them with other nearby luminance levels. In some implementations, it is possible to calculate the DFC response for all luminance levels of a particular weighting scheme and to replace those luminance levels that generate a DFC response above a certain threshold from the image with other suitable luminance levels. In either case, when a luminance level is altered to avoid or reduce DFC, a spatial dithering algorithm is used to adjust other nearby luminance values to reduce the impact on the overall image. In this way, as long as the number of luminance levels to be replaced is not too large, DFC can be minimized without severely impacting the image quality.

Another technique employs the use of bit grouping. For a given set of subframe weights, bits corresponding to smaller weights can be grouped together so as to reduce DFC whilst maintaining color rate. Since the color rate is proportional to the illumination length of the longest bit or group of bits in one image frame, this method can be useful in a subframe sequence in which there are many subframes having relatively small associated weights that sum up to be approximately equal to the largest weight corresponding to a pixel value of the weighting scheme for that particular contributing color. Two examples are provided to illustrate the concept.

EXAMPLE 1

Subframe weights w=[5, 4, 2, 6, 1, 2, 4, 7]
Color ordering RGB RGB RGB RGB RGB RGB RGB RGB

EXAMPLE 2

Subframe weights w=[5, 4, 2, 6, 1, 2, 4, 7]
Color ordering RR GG BB RRRRGGGGBBBB RR GG BB In the second example, the use of two adjacent red subframes effectively groups the first two bits (weights 5 and 4) together to improve DFC at the expense of a slightly reduced color rate.

For displays that utilize FSC methods for image generation, such as some of the MEMS-based displays described herein, additional considerations apply where the color change rate also has to be designed to be sufficiently high to avoid CBU artifact. In some implementations, the subframe images (sometimes referred to as bitplanes) of different colors fields (e.g., R, G and B fields) are loaded into the pixel array and illuminated in a particular time sequence or schedule at a high color change rate so as to reduce CBU. CBU is seen due to motion of human eye across a field of interest, which can occur when the eye is traversing across the display pursuing an object. CBU is seen usually as a series of trailing or leading color bands around an object having high contrast against its background. To avoid the CBU, color transitions can be selected to occur frequently enough so to avoid such color bands.

FIG. 16A shows an example table 1602 setting forth a subframe sequence having an increased color change frequency suitable for use by the display apparatus 128 of FIG. 1B. The table 1602 illustrates a subframe sequence for a field sequential color display employing an 8-bit per color binary code word. The subframes are ordered in FIG. 16A from left to right, where the first subframe to be illuminated in the image frame is red bit #7, and the last subframe to be illuminated is blue bit #2. The total time allowed to complete this sequence in a 60 Hz frame rate would be about 16.6 milliseconds.

In the subframe sequence 1602, the red, green and blue subframes are intermixed in time to create a rapid color change rate and reduce the CBU artifact. In this example, the number of color changes within one frame are now 9, so for a 60 Hz frame rate, the color change rate is about 9*60 Hz or 540 Hz, however a precise color change rate is determined by the largest time interval between any two subsequent colors in the algorithm.

FIG. 16B shows an example table 1604 setting forth a subframe sequence for a field sequential color display employing a 12-bit per color non-binary code word. Similar to the subframe sequence of table 1602, the subframes are ordered from right to left. For ease of demonstration, only one color (green) is shown. This implementation is similar to the subframe sequence 1602 shown in FIG. 16A, except that this implementation corresponds to a subframe sequence employing a 12-bit per color code word associated with a non-binary weighting scheme.

Flicker is a function of luminance, so different subfields of bitplanes and colors can have different sensitivities to flicker. So flicker may be mitigated differently for different bits. In some implementations, subframes corresponding to smaller bits (e.g., bits #0-3) are shown at about a first rate (e.g., about 45 Hz) while subframes corresponding to larger bits (e.g., most significant bit) are repeated at about twice or more that rate (e.g., about 90 Hz or greater). Such a technique does not exhibit flicker, and may be implemented in a variety of techniques for reducing image artifacts provided herein.

FIG. 17A shows an example table 1702 setting forth a subframe sequence for reducing flicker by employing different frame rates for different bits suitable for use by the display apparatus 128 of FIG. 1B. The subframe sequence of table 1702 implements such a technique since bits #0-3 of each color are presented only once per frame (e.g., having a rate of about 45 Hz), whereas bits #4-7 are bit split and presented twice per frame. Such a flicker reduction technique utilizes the dependence of the human visual system sensitivity on the effective brightness of a light impulse, which in the context of field sequential luminance level is related to the duration and intensity of illumination pulses. For example, in the techniques discussed herein, bits of larger weight of green show significant flicker rate sensitivity at about 60 Hz but smaller bits (e.g., bits #0-4) do not show much flicker even at lower frequencies. When combined with the larger bits, the flicker noise due to smaller bits is even less noticeable.

In some techniques, flicker-free operation below a frame rate of 60 Hz is achieved. FIG. 17B shows an example table 1704 setting forth a portion of a subframe sequence for reducing flicker by reducing a frame rate below a threshold frame rate. Specifically, the table 1704 illustrates a portion of a subframe sequence to be displayed at a frame rate of about 30 Hz. In some implementations, other frame rates below 60 Hz can be used. In this example, bit #6 and 7 are split three times and distributed substantially evenly across the frame yielding an equivalent repetition rate of about 30*3, or about 90 Hz. Bits 5, 4 and 3 are split twice and distributed substantially evenly across the frame yielding a repetition rate of about 60 Hz. Bits #2, 1 and 0 are only shown once per frame, at a rate of about 30 Hz, but their impact on flicker can be neglected since their effective brightness is very small. Thus, even though the overall frame rate may be relatively long, the effective frame rate for each significantly weighted subframe is rather high.

In some techniques, flicker may be mitigated differently for different colors. For example, in some implementations of the techniques described herein, the repetition rate of green bits can be greater than the repetition rate of similar bits (i.e., having similar weights) of other colors. In one particular example, the repetition rate of green bits is greater than the repetition rate of similar bits of red, and the repetition rate of those red bits is greater than the repetition rate of similar bits of blue. Such a flicker reduction method utilizes the dependence of the human visual system sensitivity on the color of the light, whereby the human visual system is more sensitive to green than red and blue. As a concrete example, a frame rate of at least about 60 Hz eliminates the flicker of the green color but a lower rate is acceptable for red and an even lower rate is acceptable for blue. For blue, flicker can be mitigated for a rate of about 45 Hz for reasonable brightness ranges between about 1-100 nits, which is commonly associated with mobile display products.

In some techniques, intensity modulation of the illumination is used to mitigate flicker. Pulse width modulation of the illumination source can be used in displays described herein to generate luminance levels. In certain operating modes of the display, the load time of the display can be larger than the illumination time (e.g., of the LED or other light source) as shown in the timing sequence 1802 of FIG. 18A.

Figure 18B:
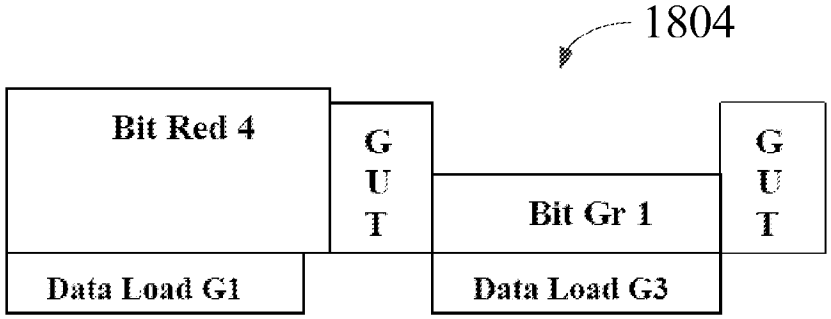
FIGS. 18A and 18B show example graphical representations corresponding to a technique for reducing flicker by modulating the illumination intensity.
Figure 18A:
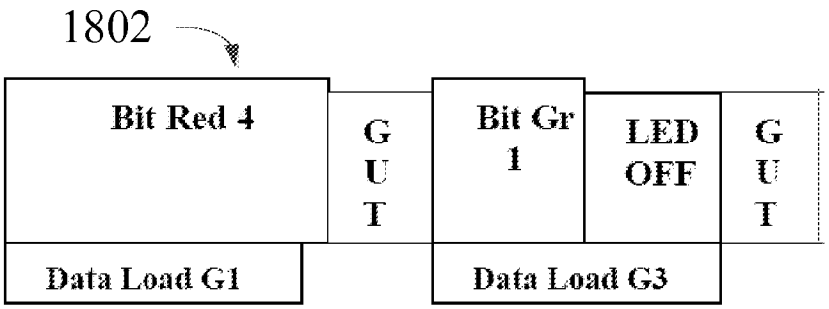

FIGS. 18A and 18B show graphical representations corresponding to a technique for reducing flicker by modulating the illumination intensity. The graphical representations 1802 and 1804 include graphs where the vertical axis represents illumination intensity and the horizontal axis represents time.

The time during which the LED is off introduces unnecessary blank periods which can contribute to flicker. In the graphical representation 1802, intensity modulation is not used. For example, the subframe corresponding to red bit #4 is illuminated when a data load occurs for the subframe associated with green bit #1 ('Data Load G1'). When the subframe associated with green bit #1 is illuminated next, it is illuminated at the same illumination intensity as the subframe associated with red bit #4. The weight of the green bit #1 is so low, though, that at this illumination intensity, the desired luminance provided by the subframe is achieved in less time than the time taken to load in the data for the next subframe. Thus, the LED is turned off after the green bit #1 subframe illumination time is complete. Thus, the LED needs to be turned off after the green bit #1 subframe illumination time is complete. This can be seen by the block LED OFF in FIG. 18A. GUT, as indicated in Figures represents a global update transition of the displays.

FIG. 18B shows a graphical representation 1804 representing where flicker is mitigated by varying the illumination intensity. In this example, the illumination intensity of the LED for the green bit #1 subframe is decreased and the duration of that subframe is increased so as to occupy the full length of the data load time for the next subframe ('Data Load G3'). This technique can reduce or eliminate the time during which the LED is off and improves flicker performance. In addition, as LEDs operate more efficiently at lower intensities due to their non-linear response to increases in drive current, by allowing LEDs to operate at lower intensity levels, this technique can also reduce the power consumption of the display apparatus.

In some techniques, multiple color field schemes (e.g., two, three, four, or more) are used in an alternating manner in subsequent frames to mitigate multiple image artifacts, such as DFC and CBU, concurrently.

FIG. 19 shows an example table 1900 setting forth a two-frame subframe sequence that alternates between use of two different weighting schemes through a series of image frames. The code words used in the subframe sequence corresponding to Frame 1 are selected from a weighting scheme that is designed to reduce CBU, while the code words used in the subframe sequence corresponding to Frame 2 are selected from a weighting scheme that is designed to reduce DFC. It may be appreciated that the arrangement of colors and/or bits also can be changed between the subsequent frames.

In some implementations, different sets of degenerate code words corresponding to all luminance levels of a contributing color according to a particular weighting scheme can be utilized for generating subframe sequences. In this way, subframe sequences can select code words from any of the various sets of degenerate code words to reduce the perception of image artifacts. For instance, a first set of code words corresponding to a particular weighting scheme can include a list of code words for each luminance level of the particular contributing color that can be generated according to the corresponding weighting scheme. A corresponding number of other sets of code words corresponding to the same-weighting scheme can include a list of different code words for each luminance level of the particular contributing color that can be generated according to the corresponding weighting scheme. By having multiple sets of code words for each luminance level of the particular contributing color, one or more of the techniques described herein can generate subframe sequences using code words from the different set of code words. In some implementations, the different set of code words can be complementary to one another, for use when specific luminance levels are displayed spatially or temporally adjacent to one another.

In some techniques, combinations of other techniques are employed to reduce DFC, CBU and flicker. FIG. 20 shows an example table 2000 setting forth a subframe sequence combining a variety of techniques for mitigating DFC, CBU and flicker. The subframe sequence corresponds to a binary weighting scheme, however, other suitable weighting schemes may be utilized in other implementations. These techniques include the use of bit splitting and the grouping together in time of the color subframes with the most significant weights or illumination values.

As described above with respect to FIG. 15B, bit-splitting provides additional flexibility in the design of a subframe sequence, and can be used for the reduction of DFC. While the subframe sequence 1602 illustrated in FIG. 16A has the advantage of a high color change frequency, it is less advantaged with respect to DFC effects. This is because, in the subframe sequence 1602, each of the bit numbers is illuminated only once per frame and there results a time gap or time separation between illuminated subframes having larger weightings. For instance, the subframes corresponding to red #6 and red #5 can be separated by as much as 5 milliseconds in the subframe sequence 1602.

In contrast, the subframe sequence of FIG. 20 corresponds to a technique where the most significant bits of a given color are grouped closely together in time. In this technique, the most significant bits #4, 5, 6 and 7 not only appear twice in each frame, but they are also ordered such that they appear adjacent to each other in the subframe sequence. As a result of this grouping of bit #s, in the image areas with the highest luminance levels, the lamps of a single color appear to be illuminated as nearly a single pulse of light, although in fact they are illuminated in a sequence which persists over only a short interval of time (for instance within a period of less than 4 milliseconds). In the example subframe sequence corresponding to table 2000, this grouping of most significant bits (MSB) illuminated subframes occurs twice within each frame for each color.

In general, any close temporal association of the MSB subframes can be characterized by the visual perception of a temporal center of light. The eye perceives the close sequence of illuminations as occurring at a particular and single point in time. The particular sequence of MSB subframes within each contributing color is designed to minimize any perceptual variation in the temporal center of light, despite variations in luminance levels which will occur naturally between adjacent pixels. In the example subframe sequence shown in FIG. 20, for each contributing color, the bit having the largest weighting is arranged toward the center of the grouping, with consecutively lower weighting bits on both sides of the bit sequence, so as to reduce DFC.

The concept of a temporal center-of-light (by analogy to the mechanical concept center-of-mass) can be quantified by defining the locus G(x) of a light distribution, which is expected to exhibit slight variations in time depending on particular luminance level x:

$$G(x) = \frac{\sum_{i=1}^{N} [M_i(x)] * W_i * T_i}{x} \qquad \text{Eqn. 2}$$

where x is a given luminance level (or section of the luminance level shown within the given color field), $M_i(x)$ is the value for that particular luminance level for bit i (or section of the luminance level shown in the given color field), $W_i$ is the weight of the bit, N is the total number of bits of the same color, and $T_i$ is the time distance of the center of each bit segment from the start of the image frame. G(x) defines a point in time (with respect to the frame start time) at the center of the light distribution by summation over the illuminated bits of the same color field, normalized by x. DFC can be reduced if one specifies a sequential ordering of the subframes in the subframe sequence such that variations in G(x), meaning G(x)−G(x−1), can be minimized over the various luminance level levels x.

In an alternative implementation for the subframe sequence, the bit having the largest weighting is arranged towards one end of the sequence with consecutively lower weighting bits placed on one side of the most significant bit. In some implementations, intervening bits of one or more different contributing colors are disposed between the grouping of most significant bits for a given color.

In some implementations, the code word includes a first set of most significant bits (e.g., bit #4, 5, 6 and 7) and a second set of least significant bits (e.g., bit #0, 1, 2 and 3), where the most significant bits have larger weightings than the least significant bits. In the example subframe sequence corresponding to the table 2000, the most significant bits for a color are grouped together and the least significant bits for that color are positioned before or after the group of most significant bits for that contributing color. In some implementations, at least some of the least significant bits for that color are placed before or after the group of most significant bits for that color, with no intervening bits for a different color, as shown for the first six code word bits of the subframe sequence corresponding to the table 2000. For example, the subframe sequence includes the placement of bits #7, 6, 5, and 4 in close proximity to each other. Alternative bit arrangements include 4-7-6-5, 7-6-5-4, 6-7-5-4 or a combination thereof. The smaller bits are distributed evenly across the frame. Furthermore, bits of the same color are kept together as much as possible. This technique can be modified such that any desired numbers of bits are included in the most significant bit grouping. For example, a grouping of the 3 most significant bits or the 5 most significant bits groups also may be employed.

The implementation illustrated also shows how effects can be managed in the output sequence. The width of each subframe corresponds to a frame rate. For each color, bits #7, 6, 5 and 4 are repeated twice in one frame. These most significant bits require higher frequency of appearance in order to reduce flicker rate (e.g., typically at least 60 Hz, preferably more) due to their high effective brightness, which in this context is directly related to the bit weighting. By showing these bits twice, one can allow for an input frame rate that is lower than 60 Hz, while still keeping the frequency of the most significant bits high (twice the frame rate). The least significant bits #0, 1, 2 and 3 are only shown once per frame. However, it also may be appreciated that the human visual system is not that sensitive to flicker for the bits with the lowest weights. A frame rate of about 45 Hz is sufficient to suppress flicker for such low effective brightness bits. The average frame rate of about 45 Hz for all the bits is sufficient for this implementation. The larger bits still end up with about 45*2=90 Hz. The frame rate can be further reduced if further bit splitting is carried out for bit #3 and #2 since the lowest effective brightness bits will have even lower sensitivity to flicker. The implementation of this technique is heavily dependent on application.

The implementation illustrated further includes an arrangement of least significant bits (e.g., bits #0, 1, 2 and 3) for a color in mutually different color bit groupings. For example, in the subframe sequence corresponding to the table 2000, bits #0 and 1 are located in a first grouping of red color bits, while bits #2 and 3 are located in a second grouping of red color bits, The bits of one or more different colors are located between the first and second groupings of the red color bits. A similar or different subframe sequence may be utilized for other colors. Since the least significant bits are not bright bits, it is acceptable to show them at slower rates from a flicker perspective. Such a technique can lead to significant power savings by reducing the number of transitions that occur per frame.

FIG. 21A shows an example table 2102 setting forth a subframe sequence for mitigating DFC, CBU and flicker by grouping bits of a first color after each grouping of bits of one of the other colors, according to an illustrative implementation. Specifically, FIG. 21A illustrates an example subframe sequence corresponding to a technique that provides for a grouping of green bits after each grouping of bits of one of the other colors. Since the human eye is more sensitive to green from both a DFC and flicker perspective, a subframe sequence having a color order such as RG-BG-RG-BG can provide the same or similar degree of CBU as a subframe sequence with a RGB color order repetition cycle while providing a longer total time for displaying more green bits (for binary or non-binary weighting schemes) or for more splits of green bits. FIG. 21B shows an example table 2104 setting forth a similar subframe sequence for mitigating DFC, CBU and flicker by grouping bits of a first color after each grouping of bits of one of the other colors corresponding to a non-binary weighting scheme.

In some techniques, the relative placement of displayed colors in a FSC method may reduce image artifacts. In some implementations, green bits are placed in a central portion of a subframe sequence for a frame. The subframe sequence corresponding to table 2104 corresponding to a technique that provides for green bits to be placed in a central portion of the subframe sequence of a frame. The subframe sequence corresponds to a 10-bit code word for each color (Red, Green, and Blue) which can effectively enable the reproduction of 7-bit luminance levels per color with reduced image artifacts. The illustrated subframe sequence shows green bits located within a central portion where green bits are absent the first $1/5^{th}$ of the bits in the subframe sequence and absent the last $1/5^{th}$ of the bits in the subframe sequence. In particular, in the subframe sequence, green bits are absent the first six bits in the subframe sequence and absent the last six bits in the subframe sequence.

In some techniques, bits of a first contributing color are all within a contiguous portion of the subframe sequence including no more than about $2/3^{rd}$ of the total number of bits of the subframe sequence. For instance, placement of the green bits, which are the most visually perceivable, in such relative proximity in the subframe sequence can be employed to alleviate DFC associated with the green portion of the subframe sequence. In addition, the green bits also may be split by small weighted bits of other colors, like red and/or blue bits, so as to simultaneously alleviate CBU and DFC artifacts. For illustrative purposes, the subframe sequence demonstrates such a technique where the green bits are all within a contiguous portion of the subframe sequence including no more than $3/5^{th}$ of the total number of bits of the subframe sequence.

In some techniques, for at least one color of a subframe sequence, a most significant bit and a second most significant bit of that color are arranged such that they are separated by no more than 3 other bits in the sequence. In some such techniques, for each color in the subframe sequence, a most significant bit and a second most significant bit are arranged such that they are separated by no more than 3 other bits. The subframe sequence corresponding to table 2104 provides an example of such a subframe sequence. Specifically, the most significant blue bit (blue bit #9) is separated from the second most significant blue bit (blue bit #6) by two red bits (red bit #3 and red bit #9). Similarly, the most significant red bit (Red Bit #9) is separated from the second most significant red bit (red bit #6) by one blue bit (blue bit #6). Finally, the most significant green bit (green bit #9) and the second most significant green bit (green bit #6) are separated by one red bit (red bit #2).

In some implementations, for at least one color of the subframe sequence for a frame, two most significant bits (having the same weightings) of that color are separated by no more than 3 other bits (e.g., no more than 2 other bits, no more than 1 other bit, or no other bits) of the subframe sequence. In some such implementations, for each color in the subframe sequence, two most significant bits (having the same weightings) of each color are separated by no more than 3 other bits of the subframe sequence.

In some techniques, a subframe sequence for a frame includes a larger number of separate groups of contiguous blue bits than the number of separate groups of contiguous green bits and/or the number of separate groups of contiguous red bits. Such a subframe sequence can reduce CBU since the human perceptual relative significance of blue light, red light, and green light of the same intensity is 73%, 23% and 4%, respectively. Hence, the blue bits of the subframe sequence can be distributed as desired to reduce CBU while not significantly increasing the perceived DFC associated with the blue bits of the subframe sequence. The subframe sequence corresponding to table 2104 illustrates such an implementation where the number of separate groups of contiguous blue bits is 7 and the number of separate groups of contiguous green bits is 4. Furthermore, in this illustrative implementation, the number of separate groups of contiguous red bits is 7, which is also greater than the number of separate groups of contiguous green bits.

FIG. 22 shows an example table 2202 setting forth a subframe sequence for mitigating DFC, CBU and flicker by employing an arrangement in which the number of separate groups of contiguous bits for a first color is greater than the number of separate groups of contiguous bits for other colors. In particular, the subframe sequence corresponds to a 9-bit code word for each contributing color (red, green and blue), where the number of separate groups of contiguous blue bits is greater than both the number of separate groups of contiguous green bits and the number of separate groups of contiguous red bits. The illustrative subframe sequence 2202 has 5 separate groups of contiguous blue bits, 3 separate groups of contiguous red bits, and 3 separate groups of contiguous red bits. As may be appreciated, the specific number of groups of contiguous bits associated with the same color is provided only for illustrative purposes, and other particular numbers of groupings are possible.

In some techniques, the first N bits of a subframe sequence of a frame correspond to a first contributing color and the last N bits of the subframe sequence correspond to a second contributing color, where N equals an integer, including but not limited to 1, 2, 3, or 4. As shown in the subframe sequence corresponding to table 2202, the first two subframes of the subframe sequence correspond to red and the last two subframes of the subframe sequence correspond to blue. In an alternative implementation, the first two subframes of the subframe sequence can correspond to blue and the last two subframes of the subframe sequence can correspond to red. Such a reversal of red and blue bit sequences at the start and end of the subframe sequence for a frame can alleviate the perception of CBU fringes due to the formation of magenta color, which is a perceptually less significant color.

Having an additional color channel, such as white (W) and/or yellow (Y) can provide more freedom in implementing various image artifact reduction techniques. A white (and/or other color) field can be added not just as RGBW but also as part of groups (RGW, GBW and RBW) where more white fields are now available and reduction of DFC, CBU and/or flicker can be achieved. In the RGBW illuminated displays, a much higher efficiency of operation is possible due to the higher efficiencies of the white LEDs compared to only utilizing red, green, and blue LEDs. Alternatively, or additionally, white may be generated by a mixture of red, green and blue colors.

Figure 23A:
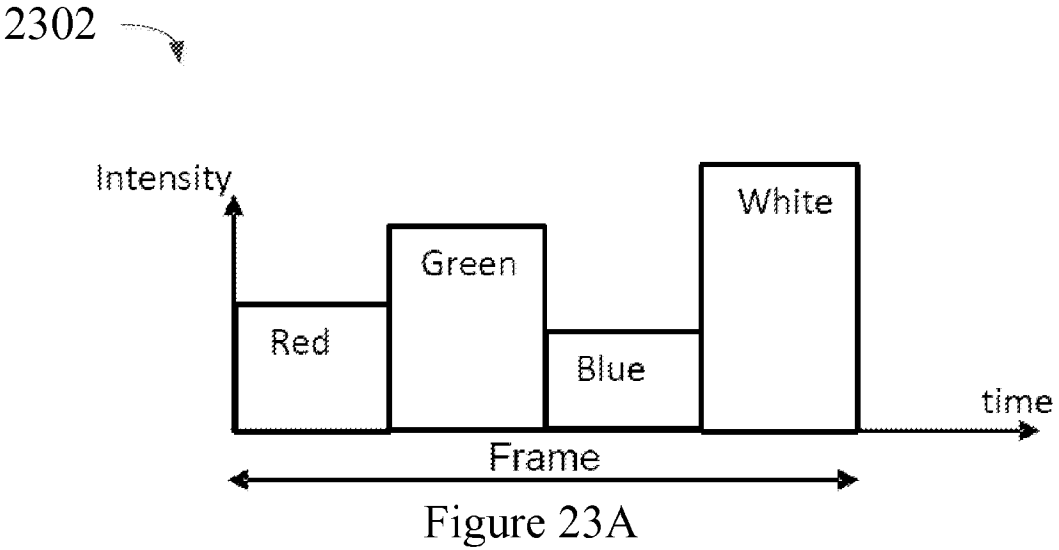
FIG. 23A shows an example illumination scheme using an RGBW backlight.

FIG. 23A shows an illumination scheme 2302 using an RGBW backlight. In the illumination scheme 2302, the vertical axis represents intensity and the horizontal axis represents time. The time in which an image frame is displayed is referred to as a frame period T. Red, green, blue and white each have a period of T/4. The periods of each of red, green, blue, and white fields can be selected to be different depending on the relative efficiencies of the LEDs. In some implementations, the frame rate can be between about 30-60 Hz, depending on the application.

Figure 23B:
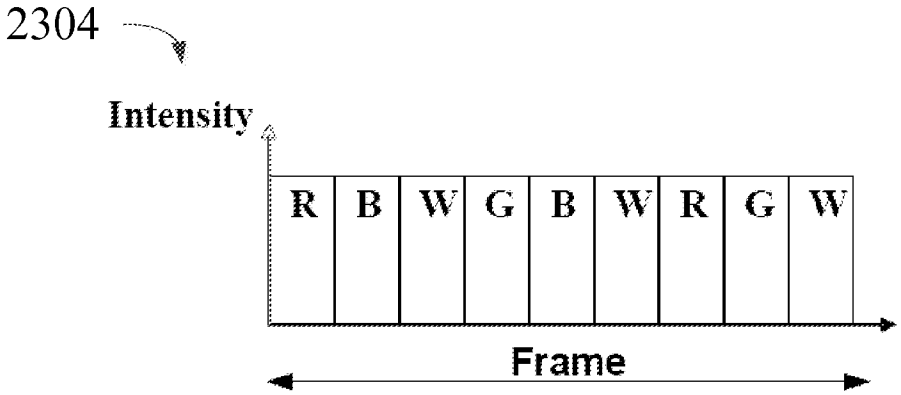
FIG. 23B shows an example illumination scheme for mitigating flicker due to repetition of the same color fields.

FIG. 23B shows an example illumination scheme 2304 for mitigating flicker due to repetition of the same color fields. Another illumination scheme may include driving the light sources (e.g., LEDs) such that any color in the color spectrum can be obtained using three contributing colors, such as RGW, RBW or GBW. This technique of obtaining any color in the color spectrum using three contributing colors, can be used to reduce the frame rate. For example, each frame period can now be divided into 9 sub frames, using a subframe sequence such as RBWGBWRGW, as illustrated in FIG. 23B. This subframe sequence can exhibit lower flicker due to the repetition of the same color fields, which enables a reduction in the frame rate. The duration of each color fields can be different depending on the efficiencies of the LEDs. In some implementations, the data rate (e.g., transition rate) can be reduced significantly as a result of reducing the frame rate. When implementing such a technique, the controller may include a conversion from RGB color coordinates to RGBW color coordinates. It may also be appreciated that a reduction in frame rate can be utilized to extend the duration time while decreasing the light intensity of the illumination pulses, thereby keeping the total emitted light constant over a frame period. The lowered light intensity equates to a lower LED operating current, which is typically a more efficient regime for LED operation.

According to another technique, the subframe sequence is constructed such that the duty cycle is different for at least two colors. Since the human visual system exhibits different sensitivity for different colors, this variation in sensitivity can be utilized to provide image quality improvement by adjusting the duty cycle of each color. An equal duty cycle per color implies that the total possible illumination time is equally divided among available colors (e.g., three colors such as red, green and blue). An unequal duty cycle for two or more colors can be used to provide a larger amount of total possible time for green illumination, less to red, and even less to blue. As illustrated in the table 2000, the sum of the widths of the subframes corresponding to green is greater than the sum of the widths of the subframes corresponding to red, which is greater than the sum of the widths of the subframes corresponding to blue. Here, the sum of the widths of the subframes for a given contributing color relative to the total width of the frame corresponds to the duty cycle of the given contributing color. This allows for extra bits and bit splits for green and red, which are relatively more important for image quality than blue. Such operation can enable lower power consumption since green contributes relatively more to luminosity and electrical power consumption (due to lower efficiency of green LEDs) than red or blue, and hence having a larger duty cycle can enable lower LED intensity (and operating current) since the effective brightness over a frame is a product of intensity and illumination time. Since LEDs are more efficient at lower currents, this can reduce power consumption by about 10-15%.

It may be appreciated that one or more of the techniques described above can be combined with one or more of the other techniques described above, or with one or more other techniques or imaging modes for displaying subframe images. An example of a subframe sequence that employs various techniques described herein is illustrated with respect to FIG. 24.

In some techniques, multiple techniques can be combined to form a single technique. As an example, FIG. 24 shows an example table 2400 setting forth a subframe sequence for reducing image artifacts using a non-binary weighting scheme for a four color imaging mode that provides extra bits to one of the contributing colors. In this particular implementation, the contributing colors include a plurality of component colors (red, green, blue) and at least one composite color (white). A composite color, white, substantially corresponds to a combination of the three remaining contributing colors. In this case, white is a composite color that is formed from a combination of the component colors, red, green and blue. In this subframe sequence, 10 bits correspond to green, while only 9 bits correspond to each of red, blue, and white.

The various illustrative logics, logical blocks, modules, circuits and algorithm processes described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and processes described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, e.g., a combination of a DSP and a microprocessor, a plurality of microprocessors, one or more microprocessors in conjunction with a DSP core, or any other such configuration. In some implementations, particular processes and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

If implemented in software, the functions may be stored on or transmitted over as one or more instructions or code on a computer-readable medium. The processes of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of any device as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. A display apparatus, comprising:

a plurality of pixels; and a controller configured to:

cause the pixels of the display apparatus to generate respective colors corresponding to an image frame by using field sequential color (FSC) image formation to display sets of subframe images corresponding to a plurality of contributing colors, the contributing colors including a plurality of component colors and at least one composite color, the composite color corresponding to a color that is substantially a combination of at least two of the plurality of component colors, wherein in displaying an image frame:

the display apparatus is caused to display a greater number of subframe images corresponding to a first component color relative to a number of subframe images corresponding to a second component color; and for at least a first contributing color of the contributing colors, the display apparatus is configured to output a given luminance of the first contributing color for a first pixel by generating a first set of pixel states and output the same luminance of the first contributing color for a second pixel by generating a second, different set of pixel states, wherein the controller is configured to display the image frame according to a subframe sequence that has a larger number of separate groups of contiguous subframes corresponding to a particular contributing color relative to a number of separate groups of contiguous subframes corresponding to other contributing color.

2. The display apparatus of claim 1, wherein the composite color comprises white or yellow and the component colors comprise at least two of red, green and blue.

3. The display apparatus of claim 1, wherein the first component color is green.

4. The display apparatus of claim 1, further comprising at least four light sources configured to cause the display apparatus to generate respective colors, wherein two of the light sources correspond to two of the plurality of component colors and one of the light sources corresponds to the composite color.

5. The display apparatus of claim 1, wherein the first pixel is adjacent to the second pixel.

6. The display apparatus of claim 1, wherein the plurality of pixels comprise MEMS light modulators formed on a transparent substrate.

7. The display apparatus of claim 1, wherein the first pixel and the second pixel correspond to the same location of the display apparatus, the first pixel corresponding to the image frame, and the second pixel corresponding to a subsequent image frame.

8. The display apparatus of claim 1, further comprising a memory configured to store a first lookup table and a second lookup table comprising a plurality of sets of pixel states for a luminance level, wherein the controller is configured to derive the first set of pixel states using the first lookup table and the second set of pixel states using the second lookup table.

9. The display apparatus of claim 8, further comprising a memory for storing a plurality of imaging modes, wherein the imaging modes correspond to a plurality of subframe sequences; and wherein the controller is configured to select an imaging mode and a corresponding subframe sequence.

10. The display apparatus of claim 1, wherein the controller is further configured to display the image frame according to a subframe sequence in which subframes having the two highest weights of a given contributing color are displayed between subframes having lower weights corresponding to the contributing color.

11. The display apparatus of claim 1, wherein the controller is further configured to display an image frame according to a first subframe sequence and a second subframe sequence, wherein the controller is configured to alternate between displaying successive image frames according to the first subframe sequence and the second subframe sequence.

12. A controller, comprising:

a processor configured to:

cause a plurality of pixels of a display apparatus to generate respective colors corresponding to an image frame by using field sequential color (FSC) image formation to display sets of subframe images corresponding to a plurality of contributing colors, the contributing colors including a plurality of component colors and at least one composite color, the composite color corresponding to a color that is substantially a combination of at least two of the plurality of component colors, wherein in displaying an image frame:

the display apparatus is caused to display a greater number of subframe images corresponding to a first component color relative to a number of subframe images corresponding to a second component color;

for at least a first contributing color of the contributing colors, the display apparatus is configured to output a given luminance of the first contributing color for a first pixel by generating a first set of pixel states and output the same luminance of the first contributing color for a second pixel by generating a second, different set of pixel states; and the display apparatus is caused to display the image frame according to a subframe sequence that has a larger number of separate groups of contiguous subframes corresponding to a particular contributing color relative to a number of separate groups of contiguous subframes corresponding to other contributing color.

13. The controller of claim 12, wherein the composite color comprises white or yellow and the component colors comprise at least two of red, green and blue.

14. The controller of claim 12, wherein the first component color is green.

15. The controller of claim 12, further configured to control at least four light sources of the display apparatus to generate respective colors, wherein two of the light sources correspond to two of the plurality of component colors and one of the light sources corresponds to the composite color.

16. The controller of claim 12, wherein the first pixel is adjacent to the second pixel.

17. The controller of claim 12, wherein the plurality of pixels comprise MEMS light modulators formed on a transparent substrate.

18. The controller of claim 12, wherein the first pixel and the second pixel correspond to the same location of the display apparatus, the first pixel corresponding to the image frame, and the second pixel corresponding to a subsequent image frame.

19. The controller of claim 12, further comprising a memory configured to store a first lookup table and a second lookup table comprising a plurality of sets of pixel states for a luminance level, wherein the controller is configured to derive the first set of pixel states using the first lookup table and the second set of pixel states using the second lookup table.

20. The controller of claim 19, comprising a memory for storing a plurality of imaging modes, wherein the imaging modes correspond to a plurality of subframe sequences; and wherein the controller is configured to select an imaging mode and a corresponding subframe sequence.

21. The controller of claim 12, wherein the controller is further configured to display the image frame according to a subframe sequence in which a subframe having an associated weight larger than respective weights associated with a majority of the subframes for a contributing color is displayed after half of the other subframes for the contributing color are displayed.

22. The controller of claim 12, wherein the controller is further configured to display an image frame according to a first subframe sequence and a second subframe sequence, and wherein the controller is configured to alternate between displaying successive image frames according to the first subframe sequence and the second subframe sequence.

23. A method for displaying an image frame on a display apparatus, comprising:

causing a plurality of pixels of a display apparatus to generate respective colors corresponding to an image frame by causing the display apparatus to display the image frame using sets of subframe images corresponding to a plurality of contributing colors according to a field sequential color (FSC) image formation process, the contributing colors comprising a plurality of component colors and at least one composite color, the composite color corresponding to a color that is substantially a combination of at least two of the plurality of component colors, wherein in displaying an image frame, causing the display apparatus to display a greater number of subframe images corresponding to a first component color relative to a number of subframe images corresponding to a second component color; and causing, for at least a first contributing color of the contributing colors, the display apparatus to output a given luminance of the first contributing color for a first pixel by generating a first set of pixel states and output the same luminance of the first contributing color for a second pixel by generating a second, different set of pixel states; and causing the image frame to be displayed according to a subframe sequence that has a larger number of separate groups of contiguous subframes corresponding to a particular contributing color relative to a number of separate groups of contiguous subframes corresponding to other contributing color.

24. The method of claim 23, wherein the composite color comprises white or yellow and the component colors comprise at least two of red, green and blue.

25. The method of claim 23, wherein the first component color is green.

26. The method of claim 23, further configured to control at least four light sources of the display apparatus to generate respective colors, wherein two of the light sources correspond to two of the plurality of component colors and one of the light sources corresponds to the composite color.

27. The method of claim 23, wherein the first pixel is adjacent to the second pixel.

28. The method of claim 23, wherein the first pixel and the second pixel correspond to a same location of the display apparatus, the first pixel corresponding to the image frame, and the second pixel corresponding to a subsequent image frame.

* * * * *